US011846028B2

(12) United States Patent
Chidambaram et al.

(10) Patent No.: US 11,846,028 B2
(45) Date of Patent: Dec. 19, 2023

(54) MOLYBDATE-BASED COMPOSITION AND CONVERSION COATING

(71) Applicant: BOARD OF REGENTS OF THE NEVADA SYSTEM OF HIGHER EDUCATION, ON BEHALF OF THE UNIVERSITY OF NEVADA, Reno, NV (US)

(72) Inventors: Dev Chidambaram, Reno, NV (US); David Rodriguez, White Rock, NM (US)

(73) Assignee: Nevada Research & Innovation Corporation, Reno, NV (US)

( * ) Notice: Subject to any disclaimer, the term of this patent is extended or adjusted under 35 U.S.C. 154(b) by 348 days.

(21) Appl. No.: 16/770,031

(22) PCT Filed: Dec. 7, 2018

(86) PCT No.: PCT/US2018/064525
§ 371 (c)(1),
(2) Date: Jun. 4, 2020

(87) PCT Pub. No.: WO2019/113479
PCT Pub. Date: Jun. 13, 2019

(65) Prior Publication Data

US 2020/0385870 A1 Dec. 10, 2020

Related U.S. Application Data

(60) Provisional application No. 62/596,550, filed on Dec. 8, 2017.

(51) Int. Cl.
*C23C 22/44* (2006.01)
*C23F 11/18* (2006.01)

(52) U.S. Cl.
CPC ..... *C23C 22/44* (2013.01); *C23F 11/187* (2013.01)

(58) Field of Classification Search
None
See application file for complete search history.

(56) References Cited

U.S. PATENT DOCUMENTS 4,775,427 A 10/1988 Portz et al.
5,604,040 A * 2/1997 Sugama ..... C23C 22/12 148/262

(Continued)

FOREIGN PATENT DOCUMENTS

CN 102732870 1/2015
EP 1 489 198 12/2004

(Continued)

OTHER PUBLICATIONS

Chidambaram et al., "Surface Pretreatments of Aluminum Alloy AA2024-T3 and Formation of Chromate Conversion Coatings, I. Composition and Electrochemical Behavior of the Oxide Film," *Journal of the Electrochemical Society*, 151(11): B605-B612, Oct. 27, 2004.

(Continued)

*Primary Examiner* — Shamim Ahmed
*Assistant Examiner* — Bradford M Gates
(74) *Attorney, Agent, or Firm* — Klarquist Sparkman, LLP

(57) ABSTRACT

Disclosed herein are embodiments of a molybdate-based composition and a conversion coating obtained therefrom that can replace conventional and toxic chromate-based conversion coatings in a variety of applications and industries. The molybdate-based composition provides conversion coatings that exhibit anodic inhibition and rapid repassivation when applied to objects, such as metal-based (Continued)

objects, and do not contain hexavalent chromium. The molybdate-based composition and conversion coating can be used to reduce corrosion. Embodiments of methods of protecting objects, such as metal surfaces, with the molybdate-based conversion coating also are disclosed.

21 Claims, 23 Drawing Sheets

(56) References Cited

U.S. PATENT DOCUMENTS 6,027,578 A * 2/2000 Marzano ..... C23C 22/40 148/274
6,214,132 B1 * 4/2001 Nakayama ..... C23C 22/78 106/14.44
8,852,358 B2 10/2014 Chang et al.
2002/0110642 A1 * 8/2002 Jaworowski ..... C23C 22/73 427/327
2003/0121569 A1 7/2003 Minevski et al.
2003/0205298 A1 * 11/2003 Block ..... C23C 22/46 148/256
2003/0234063 A1 * 12/2003 Sturgill ..... C23C 22/68 148/273
2007/0221295 A1 9/2007 Tohyama et al.
2010/0314004 A1 * 12/2010 Manavbasi ..... C23C 22/34 205/205
2013/0052352 A1 * 2/2013 Cano-Iranzo ..... C09D 165/00 252/519.31

FOREIGN PATENT DOCUMENTS

WO WO 99/61681 12/1999
WO WO 2009/048329 4/2009

OTHER PUBLICATIONS

International Search Report and Written Opinion issued for International Application No. PCT/US2018/064525 dated Apr. 12, 2019.
Rodriguez et al., "Molybdate-Based Conversion Coatings for Aluminum Alloys Part II: Coating Chemistry," *ECS Transactions*, 45(19): 91-103, Apr. 2013.
Rodriguez et al., "Molybdate-Based Conversion Coatings for Aluminum Alloys Part I: Coating Formation," *ECS Transactions*, 45(28): 1-12, Apr. 2013.
Partial European Search Report issued for EPC Application No. 18885113.3 dated Jul. 6, 2021.
Examination Report dated Jul. 6, 2023, for corresponding European Application No. 18885113.3.

* cited by examiner

MOLYBDATE-BASED COMPOSITION AND CONVERSION COATING

CROSS REFERENCE TO RELATED APPLICATION

This is the U.S. National Stage of International Application No. PCT/US2018/064525, which was published in English under PCT Article 21(2), which application in turn claims the benefit of the earlier filing date of U.S. Provisional Patent Application No. 62/596,550, filed on Dec. 8, 2017; the entirety of each of these prior applications is incorporated herein by reference.

FIELD

The present disclosure concerns molybdate-based composition embodiments and conversion coating embodiments formed from the composition, as well as methods for making and using same.

BACKGROUND

Metals having a high strength to weight ratio that are resistant to corrosion are useful in aerospace and other industries. Addition of alloying elements to such metals increases their strength but also can lower their corrosion resistance. For this reason, metal surfaces used in such industries, such as aluminum, generally are coated to improve corrosion resistance. A widely used conventional coating is a chromate conversion coating (or "CCC"). The corrosion inhibitive nature of chromates is known and has been shown to be very effective when used on aluminum alloys. By exposing the alloy to a dichromate solution, the increase in susceptibility to corrosion and pitting can be reduced.

The source of chromate used in chromate conversion coatings is usually chromic acid or potassium dichromate, both of which contain chromium in its hexavalent state, a form known to be carcinogenic. In the United States, the Environmental Protection Agency and the Occupational Safety and Health Administration lowered the permissible exposure limit to 5 $\mu g/m^3$, while the Restriction on Hazardous Substances directive in Europe has an outright ban on the use of hexavalent chromium. As such, there is a need in the art for improved conversion coatings that do not contain chromium.

SUMMARY

Disclosed herein are embodiments of molybdate-based compositions for forming molybdenum-based conversion coatings (or "MoCCs"). In some embodiments, the molybdate-based compositions comprise unique combinations of precursor components, such as a combination of a molybdenum component and a fluorine component (or a combination of fluorine components) in addition to a redox oxidizing component and/or a sulfur component. Compositional components and amounts of such components are described herein.

Also disclosed herein are embodiments of MoCCs that comprise molybdenum-containing ions, fluorine-containing ions, ions from the redox oxidizing component, and/or sulfur-containing ions. In some embodiments, the MoCCs can comprise a mixture of any one or more of $MoO_2$, $Mo_2O_5$, $MoO_4^{2-}$, and $MoO_3$, and the fluorine-containing ions, ions from the redox oxidizing component, and/or sulfur-containing ions.

Also disclosed herein are objects coated with MoCCs formed from composition embodiments described herein. Further, methods for making the MoCCs and methods of coating the objects are described.

The foregoing and other objects and features of the present disclosure will become more apparent from the following detailed description, which proceeds with reference to the accompanying figures.

DETAILED DESCRIPTION

I. Explanation of Terms

Figure 1A:
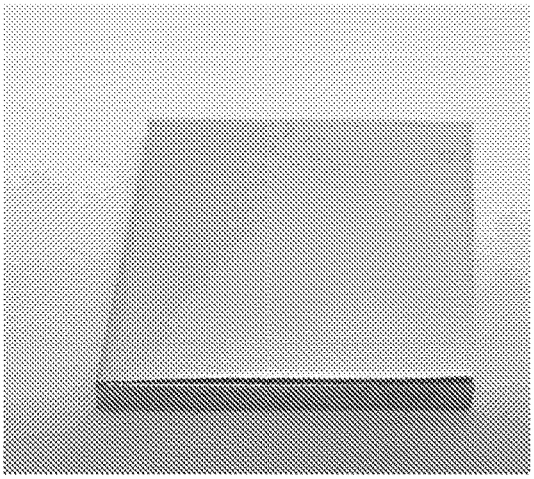
FIGS. 1A and 1B are photographs of a polished uncoated aluminum substrate (FIG. 1A), and an aluminum substrate coated with a representative molybdate-based conversion coating (or "MoCC") (FIG. 1B) as described herein.

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

The present disclosure is directed toward all novel and non-obvious features and aspects of the various disclosed embodiments, alone and in various combinations and subcombinations with one another. Any theories of operation are to facilitate explanation, but the disclosed devices and methods are not limited to such theories of operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed devices, materials, and methods can be used in conjunction with other devices and methods. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In some examples, values, procedures, or devices are referred to as "lowest," "best," "minimum," or the like. It will be appreciated that such descriptions are intended to indicate that a selection among many used functional alternatives can be made, and such selections need not be better, smaller, or otherwise preferable to other selections.

Examples are described with reference to directions indicated as "above," "below," "upper," "lower," and the like. These terms are used for convenient description, but do not imply any particular spatial orientation.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

To facilitate review of the various embodiments of the disclosure, the following explanations of specific terms are provided:

Anodic Inhibitor (Anodic Inhibition): An anodic inhibitor is a substance that inhibits the anodic reaction or process of corrosion. In some embodiments, it forms a protective oxide coating on the surface of an object, such as a metal object (and thus promotes anodic inhibition).

Barrier Layer: As used herein, a barrier layer refers to any layer that acts as a physical or chemical barrier on a metal object to other species that promote corrosion of the metal object. Solely by way of example, the MoCC can act as a barrier layer on metal objects to invading chloride ions that attack metals and/or their alloys.

Conversion Coating: A protective layer or coating formed on an object, typically a surface of a metal object, which is created by chemical reactions between metal object and a molybdate-based composition as described herein. In some embodiments, the conversion coating can be formed on a surface of the object such that it is in direct contact with the surface, or it can be formed on the surface such that it is not in direct contact with the surface. In representative embodiments, the conversion coating is formed on a surface of the object such that it is in direct contact with the surface.

Open circuit potential (OCP): OCP refers to the potential of a coated metal (or alloy thereof) surface in an electrolyte as measured against a reference electrode (e.g., Ag/AgCl) and is characteristic of the interface (e.g., the surface chemistry of the solid and the liquid electrolyte). In some independent embodiments, aluminum has a different OCP compared to representative Mo-based coatings in a given electrolyte.

Repassivation: As used herein, repassivation refers to the ability of an object comprising a representative MoCC coating to regain its open circuit potential (completely or substantially, such as to regain greater than 50%, such as 60%, 70%, 80%, 85%, 90%, 95%, 99% of its open circuit potential) after the coating is damaged. In some embodiments, repassivation can be determined by measuring the OCP (or by determining the $I_{corr}$ value) of a MoCC-coated object before and after damage has occurred. In some embodiments, repassivation can result from migration of Mo (or ions thereof) into the damaged region. This ability to spontaneously repair the damaged area is referred to as 'self-healing'.

"Substantially Covers": As used herein, the phrase "substantially covers" refers to embodiments where the disclosed conversion coating and/or the composition that provides the conversion coating covers less than 100% of surface area of the object to which it is applied, such as at least 50% of the surface area of the object, such as 60%, 70%, 80%, 90%, 95%, or 99% of the surface area of a substrate.

II. Introduction

To prevent the corrosion of certain metal alloys, such as aluminum alloys, a chromate conversion coating (CCC) can be applied to the surface. However, chromate is a carcinogen. The development of chromate-free and environmentally-friendly replacement coatings is therefore desired. The present disclosure describes environmentally-benign, molybdate-based conversion coatings (MoCCs) for the protection of objects, such as metal-based objects used in various industries typically employing metal or metal alloy components (e.g., aircrafts, cars, boats, etc.).

Due the health problems that chromate presents, it would be useful to find a less toxic alternative. Disclosed herein are embodiments of a composition that can be used to provide a conversion coating on an object, wherein the conversion coating has properties and performance characteristics suitable for use in applications and industries requiring coatings that are resistant to corrosion and degradation. The disclosed composition embodiments provide a coating that can replace conventional chromate conversion coatings as the inventive coating provide similar or improved performance as compared to chromate conversion coatings and advantageously is not toxic or hazardous. The disclosed composition embodiments comprise a unique combination of components that provide coatings capable of repassivation (also referred to herein as "self-healing"), anodic inhibition, and combinations thereof. The disclosed composition embodiments comprise molybdenum (typically in ionic form, such as a molybdenum-containing species and/or in an oxide form) and thus also is referred to herein as a molybdate-based composition. The disclosed composition embodiments provide a unique coating that exhibits properties that cannot be achieved by simply applying molybdate-based paints and/or coating films as the disclosed coating is able to self-heal when damage occurs to the MoCC such that any cracks or pits formed in the MoCC due to environmental corrosion or other damaging forces are repassivated and thereby "healed." Furthermore, the coating embodiments described herein provide different layers of molybdenum oxide species and/or molybdenum-containing species, which lends to their ability to resist different levels of corrosion. Solely by way of example, even if one layer of a deposited molybdenum oxide species and/or molybdenum-containing species formed from the disclosed composition embodiments were to be damaged by corrosion, one or more additional layers of the coating are able to resist such damage thereby providing an undercoat or barrier layer that resists corrosion damage.

III. Molybdate-Based Composition Embodiments

The molybdate-based composition embodiments described herein comprise a molybdate component that provides molybdenum ions for the coatings described herein. In some embodiments, the composition can further comprise an iron component, a redox oxidizing component, a fluorine component, a sulfur component, or any combinations thereof. In some embodiments, multiple different species of each component can be used. For example, using a fluorine component can comprise using a single fluorine-containing species, or a mixture of such species (e.g., potassium hexafluorozirconate alone or in combination with one or more of NaF or $KBF_4$). In particular disclosed embodiments, the composition can consist essentially of a molybdate component, an iron component, a redox oxidizing component, a fluorine component, and/or a sulfur component. In such embodiments, the composition is free of any components that would deleteriously affect the properties of the resulting coating formed from the composition (e.g., components that would reduce the ability of the coating to self-heal or provide anodic inhibition) and/or that would increase the toxicity of the composition or a coating made therefrom. In some embodiments, the composition can comprise, consist essentially of, or consist of a molybdate component, a fluorine component, and a sulfur component or a redox oxidizing component. In some independent embodiments, the composition can consist of a molybdate component, a fluorine component and a redox oxidizing component or a sulfur component.

In particular disclosed embodiments, the molybdate component is a molybdate precursor, such as $X_2MoO_4$ (or a mixture of molybdate precursors); the iron component is an iron ion precursor, such as a species comprising $Fe^{3+}$, $Fe^{2+}$, or a combination thereof (e.g., $X_3Fe(CN)_6$); the fluorine component is a fluoride ion precursor, such as $X_nY_mF_p$, wherein Y is selected from B, Al, Ga, In, Zr, Ti, or Tl, n is an integer ranging from 1 to 4, such as 1, 2, 3, or 4, m is an integer ranging from 0 to 3, such as 0, 1, 2, or 3, and p is an integer ranging from 1 to 8, such as 1, 2, 3, 4, 5, 6, 7, or 8. With reference to formulas comprising an "X" variable, each X independently can be selected from a suitable counterion, such as potassium, sodium, hydrogen, lithium, cesium, rubidium, or any combination of these counterions. In some embodiments, the fluorine component can have a formula XF, $X_2ZrF_6$ or $XBF_4$, wherein X is sodium or potassium. The redox oxidizing component can be a manganese-containing species (e.g., a $Mn^{2+}$—, $Mn^{3+}$-, $Mn^{4+}$-, $Mn^{6+}$-, $Mn^{6+}$-, or $Mn^{7+}$-containing species, such as iron permanganate, ammonium permanganate, barium permanganate, or any combination thereof); a chlorate-containing species (e.g., a perchlorate-containing species, such as $NH_4ClO_4$, $HClO_4$, $KClO_4$, NaClO4, or any combination thereof); a technetium-containing species (e.g., a pertechnetate-containing species, such as $LiTcO_4$, $NaTcO_4$, $RbTcO_4$, $KTcO_4$, $CsTcO_4$, $TlTcO_4$, $NH_4TcO_4$, or $AgTcO_4$); a rhenium-containing species (e.g., a perrhenate-containing species, such as $NH_4ReO_4$); a vanadium-containing species (e.g., a vanadate-containing species, such as $LiVO_3$, $NaVO_3$, $KVO_3$, $CsVO_3$, $NI_4VO_3$, $(NH_4)_3VO_4$, or any combination thereof); or even sulfuric or nitric acid. The sulfur component can comprise sulfur oxides and/or anions, including sulfates, sulfites, sulfides, and thiosulfates.

In some embodiments, the composition can comprise, consist essentially of, or consist of potassium ferricyanide, potassium hexafluorozirconate, sodium molybdate, and potassium permanganate. Such composition embodiments can further comprise a sulfate, sulfite, sulfide, and/or thiosulfate species, such as sodium sulfate, potassium sulfate, hydrogen sulfate, lithium sulfate, rubidium sulfate, cesium sulfate, sodium sulfite, potassium sulfite, bisulfate, lithium sulfite, rubidium sulfite, cesium sulfite, sodium sulfide, potassium sulfide, hydrogen sulfide, lithium sulfide, rubidium sulfide, cesium sulfide, sodium thiosulfate, potassium thiosulfate, hydrogen thiosulfate, lithium thiosulfate, rubidium thiosulfate, cesium thiosulfate, or any combinations thereof. In some embodiments, the composition can comprise, consist essentially of, or consist of potassium ferricyanide, potassium hexafluorozirconate, potassium tetrafluoroborate, sodium molybdate, sodium (and/or potassium) sulfate, sodium (and/or potassium) sulfite, sodium (and/or potassium) sulfide, and sodium (and/or potassium) thiosulfate. Such embodiments can further comprise potassium permanganate. In yet additional embodiments, the composition can comprise, consist essentially of, or consist of potassium ferricyanide, potassium hexafluorozirconate, potassium tetrafluoroborate, sodium molybdate, potassium permanganate, sodium (and/or potassium) sulfate, sodium (and/or potassium) sulfite, sodium (and/or potassium) sulfide, and sodium (and/or potassium) thiosulfate. In some embodiments, the disclosed composition embodiments do not comprise (that is, exclude) chromium.

In particular disclosed embodiments, the molybdate, iron, fluorine, redox oxidizing, and sulfur components each can be provided in particular concentrations. In some embodiments, the concentration of each component can be selected to tune the ability of the resulting coating to exhibit anodic resistance and/or repassivation. In some embodiments, the composition can comprise 0 mM to 100 mM of the fluorine component (or a mixture of fluorine components), such as greater than 0 mM to 100 mM, or 0.01 mM to 100 mM, or 0.02 mM to 75 mM, or 0.045 mM to 75 mM, or 0.1 mM to 50 mM, or 40 mM to 60 mM. In embodiments comprising a mixture of fluorine components, the fluorine components can be present such that the total amount of the mixture of the fluorine components ranges from greater than 0 mM to 100 mM, such as 0.01 mM to 100 mM, or 0.02 mM to 75 mM, or 0.045 mM to 75 mM, or 0.1 mM to 50 mM, or 40 mM to 60 mM. In some embodiments, the disclosed composition embodiments comprise $1\times10^{-4}$ mM to 0.1 mM of an iron component, such as $1\times10^{-3}$ mM to $5\times10^{-2}$ mM, or $7.5\times10^{-3}$ mM to $1.5\times10^{-2}$ mM. In some embodiments, the disclosed composition embodiments comprise 0.1 mM to 150 mM of the molybdate component, such as 1 mM to 130 mM, or 10 mM to 125 mM, or 100 mM to 130 mM. In some embodiments, the disclosed composition embodiments comprise 0 mM to 50 mM of the redox oxidizing component, such as greater than 0 mM to 20 mM, or 0.1 to 25 mM, or 1 to 20 mM, or 1 mM to 15 mM, or 2 mM to 10 mM, or 2 mM to 5 mM. In some embodiments, the disclosed composition embodiments comprise 0 to 100 mM of the sulfur component (or a mixture of sulfur components), such as greater than 0 mM to 50 mM, or $1\times10^{-5}$ mM to 50 mM, or $1\times10^{-4}$ mM to 25 mM or $1\times10^{-4}$ mM to 15 mM, or $1\times10^{-4}$ mM to 5 mM. In embodiments comprising a mixture of sulfur components, the sulfur components can be present such that the total amount of the mixture of the sulfur components ranges from greater than 0 mM to 100 mM of the sulfur component (or a mixture of sulfur components), such as $1\times10^{-5}$ mM to 50 mM, or $1\times10^{-4}$ mM to 25 mM or $1\times10^{-4}$ mM to 15 mM, or $1\times10^{-4}$ mM to 5 mM.

In particular disclosed embodiments, the composition can comprise, consist essentially of, or consist of (i) 0.1 mM to 75 mM NaF, or $K_2ZrF_6$, or $KBF_4$, or any combination thereof, such as 0.1 mM to 60 mM, or 0.1 mM to 50 mM; (ii) 0.1 mM to 150 mM $Na_2MoO_4$, such as 100 mM to 130 mM, or 100 mM to 125 mM; and (iii) 1 mM to 15 mM $KMnO_4$, such as 2 to 10 mM, or 2 mM to 5 mM. In some such embodiments, the composition can further comprise $1\times10^{-5}$ mM to 50 mM sodium (and/or potassium) sulfate, sodium (and/or potassium) sulfite, sodium (and/or potassium) sulfide, and/or sodium (and/or potassium) thiosulfate, such as $1\times10^{-5}$ mM to 25 mM, or $1\times10^{-5}$ mM to 10 mM. Also, in some such embodiments, the composition can further comprise $1\times10^{-4}$ mM to 0.1 mM $K_3Fe(CN)_6$, such as $1\times10^{-3}$ mM to $5\times10^{-2}$ mM, or $7.5\times10^{-3}$ mM to $1.5\times10^{-2}$ mM.

In yet some additional embodiments, the composition can comprise, consist essentially of, or consist of (i) 0.1 mM to 75 mM of a mixture of NaF, $K_2ZrF_6$, and $KBF_4$, such as 0.1 mM to 60 mM, or 0.1 mM to 50 mM; (ii) 0.1 mM to 150 mM $Na_2MoO_4$, such as 100 mM to 130 mM, or 100 mM to 125 mM; and (iii) $1\times10^{-5}$ mM to 50 mM sodium (and/or potassium) sulfate, sodium (and/or potassium) sulfite, sodium (and/or potassium) sulfide, and/or sodium (and/or potassium) thiosulfate, such as $1\times10^{-5}$ mM to 25 mM, or $1\times10^{-5}$ mM to 10 mM. In some such embodiments, the composition can further comprise $1\times10^{-4}$ mM to 0.1 mM $K_3Fe(CN)_6$, such as $1\times10^{-3}$ mM to 5×10-2 mM, or $7.5\times10^{-3}$ mM to $1.5\times10^{-2}$ mM and/or 1 mM to 15 mM $KMnO_4$, such as 2 to 10 mM, or 2 mM to 5 mM. In particular disclosed embodiments, the compositions comprise any combination of 0.125 M sodium molybdate, 0.05 M potassium hexafluorozirconate, 0.045 mM NaF, 0.16 mM $KBF_4$, 0.03 mM $Na_2S_2O_3$, 0.0001 mM $Na_2SO_4$, and/or 5 mM $KMnO_4$.

Embodiments of the disclosed composition embodiments may be acidic, meaning they have a pH lower than 7. In some embodiments, the composition can have a pH of 0.1 to 5, such as 0.2 to 4 or 0.5 to 2.5. The pH of the composition may be modified to be acidic by adding an organic or inorganic acid component, such as nitric acid, sulfuric acid, citric acid, malic acid, tetraacetic acid, hydrofluoroic acid, manganic acid, and combinations thereof. In particular disclosed embodiments, nitric acid may be used to lower the pH of the composition. In some embodiments, the disclosed composition comprises 0.0001 to 10 mM of the acid, such as $1\times10^{-2}$ to $10\times10^{-2}$ mM of the acid.

In embodiments where an acid is added, the acid does not deleteriously affect the corrosion resistance of the coating made from the composition.

Also disclosed herein are kit embodiments that comprise components of the molybdate-based composition disclosed herein. In some embodiments, the kit can comprise a combination of the composition components described above. In some embodiments, the kit can comprise a container containing the molybdate component, the fluorine component, the iron component, or any combination thereof. Such embodiments of the kit may also further comprise separate containers comprising, independently, the redox oxidizing component and the sulfur component. In yet some embodiments, the kit can comprise a container that contains the molybdate component, the iron component, the redox oxidizing component, and the sulfur component. In yet additional embodiments, the kit can further comprise a separate container comprising an acid (e.g., an inorganic or an organic acid) that can be combined with the components of one or more additional containers. In some embodiments, the kit can comprise the molybdate component, the iron component, the redox oxidizing component, the sulfur component, and an acid.

IV. Molybdate-Based Conversion Coating Embodiments

As described above, the molybdate-based compositions disclosed herein can be used to form a molybdate-based conversion coating (or "MoCC"). The MoCC typically is formed on an object that needs protection from corrosion and other stresses from a surrounding environment. For example, the MoCC disclosed herein can be used on objects typically used in the aerospace field, the automobile industry, or the nautical industry. For example, the coatings are suited for use on the parts of airplanes, boats, and cars that typically are exposed to stresses that cause corrosion and/or damage to the airplane, boat, or car. In particular disclosed embodiments, the MoCC embodiments described herein can be used on objects to create a surface that is suitable for paint adhesion. Solely by way of example, the MoCC embodiments described herein can be applied to an object, and then a primer and an outer topcoat paint layer can be provided. In particular disclosed embodiments, the object typically is a metal object and comprises aluminum, magnesium, and/or iron and often can be made of or contain an aluminum alloy, a magnesium alloy, an iron alloy, or any combinations thereof. Without being limited to a particular theory, it currently is believed that adding the MoCC to an object's surface improves paint adherence because it can prepare the object's surface to be painted by removing organic impurities on the surface, and it can provide porous surface that increases adhesion leading to more interaction between the MoCC and a primer layer.

In particular disclosed embodiments, the MoCC embodiments described herein can be formed from the compositions disclosed above. As such, some embodiments of the MoCC can comprise molybdenum-containing species (e.g., one or more of $Mo_2O_5$, $MoO_4^{2-}$, $MoO_2$, and $MoO_3$), fluorine ions, ions formed from the disclosed redox oxidizing agent, sulfur ions, and any combination thereof. In some embodiments, the MoCC can comprise molybdenum-containing species (e.g., one or more of $Mo_2O_5$, $MoO_4^{2+}$, $MoO_2$, and $MoO_3$), fluorine ions, permanganate ions, perchlorate ions, pertechnetate ions, perrhenate ions, vanadate ions, (and any combination thereof), sulfur ions, and any combinations thereof. Without being limited to a particular theory, it currently is believed that the MoCC is formed via redox reactions of molybdenum-containing species present in the composition and a component of the object being coated, such as a metal object. The redox reaction can promote formation of different forms of molybdenum-containing species which can be reduced as the metal object undergoes oxidation. This reactivity can produce the MoCC, which contains internal layers of different molybdenum oxide species (e.g., $Mo_2O_5$, $MoO_2$, and/or $MoO_3$), or molybdenum-containing species (e.g., $MOO_4^{2-}$), or any combinations thereof. In particular disclosed embodiments, the MoCC can comprise an initial layer that forms on the metal object. This initial layer can comprise a mixture of $Mo_2O_5$, $MoO_4^{2-}$, $MoO_2$, and $MoO_3$ species. The MoCC also can comprise a second layer formed on the initial layer that comprises $Mo_2O_5$ and $MoO_4^{2-}$ species. In some embodiments, the coating can form a barrier layer when the coating is applied to a surface of the object. The barrier layer can comprise an outer layer comprising $Mo^{+5}$ and $Mo^{+6}$ ions and an inner layer comprising $Mo^{+4}$.

Figure 40:
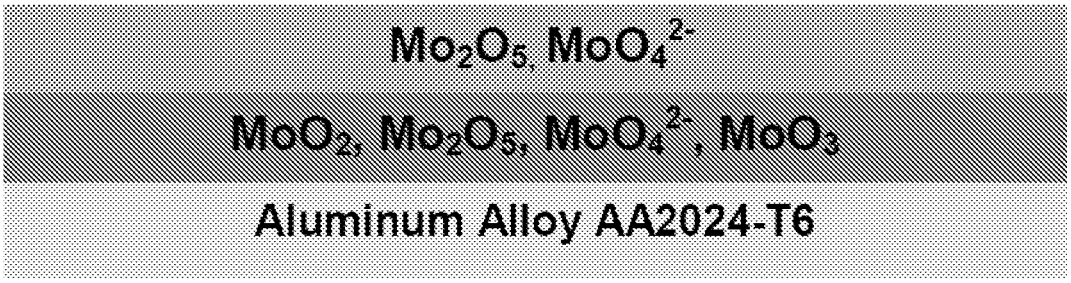
FIG. 40 is a diagram illustrating the molybdenum-containing species present in a cross-sectional view of an exemplary MoCC on an aluminum substrate, in an embodiment prepared as described herein.

A representative schematic of a representative MoCC embodiment is illustrated in FIG. 40. Additional layers also can be formed, but need not be formed for the MoCC to exhibit the desired repassivation and/or anodic inhibition. In particular disclosed embodiments, the two (or more) layers that are formed can exist as distinct layers (e.g., layers that can be determined to have separate thicknesses using an imaging technique, such as SEM or TEM) or they may exist as integral layers that are not necessarily distinguishable from one another using an imaging technique, such as SEM or TEM. In some embodiments, the layers of the MoCC can have thicknesses ranging from about 10 nm to 10 μm. In particular disclosed embodiments, the thickness can range from 0.05 to 1 μm and more typically is a thickness ranging from 0.1 to 0.5 μm.

As described herein, the MoCC embodiments made using the compositions described herein exhibit the ability to self-heal via repassivation. Without being limited to a particular theory, it is currently believed that the different molybdenum-containing species present in the MoCC can migrate between the different layers of the MoCC. For example, when the MoCC is scratched or damaged, molybdenum-containing species are able to migrate to and passivated the damaged area, thereby preventing any further corrosion. This can be evidenced by monitoring the open circuit potential (or "OCP") of an object coated with an embodiment of the MoCC in a salt solution (e.g., 0.05 M NaCl) before and after the surface of the MoCC is scratched. Typically, after scratching the MoCC surface, a sudden drop in potential will be observed, which indicates that the surface has become more active since the underlying object (e.g., aluminum) was exposed. Typically, the OCP will then increase back to what it was before the coating was scratched (or substantially close thereto), thereby indicating that the coating has healed itself. In particular disclosed embodiments, the MoCC embodiments exhibit repassivation within a very short time period. For example, some embodiments of the disclosed MoCC may exhibit repassivation in 5 minutes or less, such as 3 minutes or less, or 2 minutes or less, or even 60 seconds or less after the MoCC is scratched. In some embodiments, the MoCC embodiments can exhibit an OCP of −500 to −750 mV versus an Ag/AgCl standard reference electrode, such as an OCP of −550 to −650 mV. For comparison, the OCP of conventional CCC's can typically range from −500 to −600 mV. In yet additional embodiments, the MoCC embodiments can exhibit anodic inhibition, but do not exhibit cathodic inhibition, which typically is exhibited by conventional conversion coatings, such as CCCs.

In a representative embodiment, a MoCC was applied to an aluminum alloy substrate and provided a corrosion potential from −670 mV to −600 mV versus an Ag/AgCl reference electrode. Additionally, the number of corrosion pits was reduced on the MoCC-coated sample when compared to uncoated substrate samples. The repassivation ability of embodiments of the disclosed MoCCs can be examined by scratching the coated sample with a glass tip and measuring the open circuit potentials (OCP). In a representative embodiment, the OCP rapidly dropped after scratching due to the exposed underlying alloy; however, the OCP also rapidly traced back to its pre-scratch potential, indicating that the MoCC possessed the ability to 'self-heal' via repassivation.

In particular disclosed embodiments, scanning electron microscopy (SEM) analysis can be used to analyze embodiments of the MoCCs disclosed herein, after application to a substrate. In some embodiments, the SEM result confirmed that the MoCC exhibited a surface morphology having a mud cracked pattern similar to what would be seen on a sample coated with a CCC. In some additional embodiments, ultraviolet-visible (UV-Vis), Raman, Fourier Transform-Infrared (FT-R) and energy dispersive (XRD) spectroscopy methods as well as X-ray photoelectron spectroscopy (XPS) can be used to confirm the presence of the MoCC on the surface of an object. These analytical techniques can be used to confirm that a protective layer of MoCC is in fact deposited and formed on an object after exposing the object to a composition embodiment described herein.

V. Method of Making Molybdate-Based Composition and Conversion Coating Embodiments Disclosed herein are embodiments of making a molybdate-based composition and a conversion coating formed from the composition. In some embodiments, the molybdate-based composition can be formed by combining the components of the composition as separate stock solutions. For example, separate stock solutions of the molybdate component(s) and the iron component(s), and the redox oxidizing component(s), and/or the sulfur component(s) can be prepared by combining each component separately with water. Amounts of each stock solution are then combined and mixed to obtain the desired concentration of each component and thereby provide the composition. In some embodiments, the method can further comprise adding an amount of an acid to the composition to lower the pH of the composition to a desired pH as described herein. In some embodiments, 1 M $HNO_3$ can be added until the pH is lowered (such as to a pH of 1.5). The composition can then be allowed to equilibrate prior to exposing an object to the composition.

Once the composition has been prepared, it can be used to coat (or substantially coat) an object. The object is exposed to the composition to for an amount of time sufficient to form the corresponding conversion coating on the object. In some embodiments, the amount of time during which the object is exposed to the composition can range from one minute or less to 15 minutes, or from 2 minutes to 12 minutes, or from 5 minutes to 10 minutes. In particular disclosed embodiments, the object is exposed to the composition for 7 minutes. A person of ordinary skill in the art will recognize with the benefit of this disclosure that the amount of time may increase or decrease depending on the size of the object to be coated.

In some embodiments, the MoCC composition is deposited on an object to form the conversion coating. Exemplary methods for depositing the MoCC composition can include, but are not limited to, spray coating, dipping, sputtering, printing, painting, or submerging, the object in (or with) the MoCC composition. Any other suitable deposition methods also can be used. In some embodiments, the MoCC can form a single continuous (that is, an uninterrupted) layer directly on a surface of the substrate. In some embodiments, the MoCC can be applied so as to form a coating on particular areas of the object and not on other areas, such as by depositing the composition in a pattern on the object. In some embodiments, the MoCC can form a layer that completely covers a surface of the object (e.g., 100% of the surface area) or that substantially covers a surface of the object (e.g., at least 50% of the surface area of the object, such as 60%, 70%, 80%, 90%, 95%, or 99% of the surface area of a substrate). The MoCC will form a separate layer on a surface of the object and it can have a thickness ranging from 10 nm to 10 mm, such as 25 nm to 5 mm, or 50 nm to 1 mm, or 100 nm to 500 nm. After the MoCC has formed on the object, the object can be rinsed with water and dried (either using an affirmative drying step, such as heating the object, blotting the object, or passing an inert gas over the object, or by allowing the object to dry under ambient conditions).

VI. Method of Using Molybdate-Based Composition and Conversion Coating Embodiments The molybdate-based composition described herein can be used to form molybdate-based conversion coatings on an object, such as a metal object. The object typically is made of aluminum, magnesium, iron, or an alloy of aluminum, magnesium, and/or iron, or any combination thereof. The MoCCs disclosed herein may be used to protect an object from corrosion and/or to reduce the amount of wear due to corrosion. In some embodiments, MoCCs formed from a composition embodiments comprising a a redox oxidizing component, a sulfur component, or any combinations thereof (as described above) can provide superior corrosion protection as compared to MoCCs formed from compositions without these components. In some embodiments, MoCCs formed from compositions comprising a redox oxidizing component, a sulfur component, or any combinations thereof can exhibit $I_{corr}$ values of less than 0.9 $\mu A/cm^2$, such as $I_{corr}$ values of less than 0.8 $\mu A/cm^2$, or 0.7 $\mu A/cm^2$, 0.5 $\mu A/cm^2$, or 0.1 $\mu A/cm^2$. In some embodiments, MoCCs formed from compositions comprising a redox oxidizing component, a sulfur component, or any combinations thereof can exhibit $I_{corr}$ values of 0.01 $\mu A/cm^2$ or less, such as between 0.01 $\mu A/cm^2$ and 0.0020 $\mu A/cm^2$, such as 0.0025 $\mu A/cm^2$.

In some embodiments, methods of protecting a metal surface from corrosion include the steps of preparing a MoCC composition as disclosed herein, and contacting a metal surface with the composition to form a conversion coating on the metal surface. In such embodiments, contacting the object can comprise any of the deposition methods described above. Any of the MoCCs described herein may be used in to protect a substrate from corrosion and/or to reduce the amount of wear due to corrosion. In some embodiments, the disclosed MoCCs can exhibit repassivation at a rate that is the same or that is superior to a CCC.

In particular disclosed embodiments, the composition is used to provide a conversion coating that covers or substantially covers parts of aircraft, vehicles, and/or boats. In exemplary embodiments, the composition is used to provide a conversion coating that protects airplane wings and other components of an aircraft from corrosion.

VII. Overview of Several Embodiments

Disclosed herein are embodiments of a composition, comprising: 0.1 to 75 mM of a single fluorine component having a formula $X_nY_mF_p$, or a combination of such fluorine components; 1 to 150 mM $X_2MoO_4$; and 1 to 15 mM of a redox oxidizing component comprising a permanganate species, a perchlorate species, a pertechnetate species, a perrhenate species, or a vanadate species; wherein each X independently is a counterion selected from potassium, sodium, hydrogen, lithium, rubidium, or cesium; Y is selected from B, Al, Ga, In, Zr, Ti, or Tl; n is an integer selected from 1, 2, or 3; m is an integer selected from 0, 1, 2, or 3; p is an integer selected from 1, 2, 3, 4, 5, or 6; and wherein the pH of the composition ranges from 0.5 to 2.5, and the composition does not comprise chromium.

In any or all of the above embodiments, the composition further comprises 0.0001 to 50 mM $Na_2SO_4$, 0.0001 to 50 mM $Na_2SO_3$, or a combination thereof.

In any or all of the above embodiments, the composition further comprises 0.03 to 100 mM $Na_2S_2O_3$.

In any or all of the above embodiments, the composition further comprises 0.0001 mM to 10 mM of an acid.

In any or all of the above embodiments, the composition comprises 0.1 to 75 mM NaF, or $K_2ZrF_6$, or $KBF_4$, or any combination thereof, 1 to 150 mM $Na_2MoO_4$; and 1 to 15 mM $KMnO_4$.

In any or all of the above embodiments, the composition comprises 40 to 60 mM $K_2ZrF_6$; 100 to 130 mM $Na_2MoO_4$; and 2 to 10 mM $KMnO_4$.

In any or all of the above embodiments, the composition comprises 0.125 M $Na_2MoO_4$; 0.05 M $K_2ZrF_6$; and 5 mM $KMnO_4$.

Some embodiments of the disclosed compositions comprise 0.1 to 75 mM of a single fluorine component having a formula $X_nY_mF_p$, or a combination of such fluorine components; 1 to 150 mM $X_2MoO_4$; and 0.0001 to 50 mM $X_2SO_4$, $X_2SO_3$, $X_2S_2O_3$ or any combination thereof, wherein each X independently is a counterion selected from potassium, sodium, hydrogen, or lithium; Y is selected from B, Al, Ga, In, Zr, Ti, or Tl; n is an integer selected from 1, 2, or 3; m is an integer selected from 0, 1, 2, or 3; p is an integer selected from 1, 2, 3, 4, 5, or 6; and wherein the pH of the composition ranges from 0.5 to 2.5, and the composition does not comprise chromium.

In any or all of the above embodiments, the composition comprises 0.0001 to 5 mM $Na_2SO_4$ and 0.03 to 5 mM $Na_2S_2O_3$.

In any or all of the above embodiments, the composition comprises 0.1 to 75 mM of a mixture comprising NaF, $K_2ZrF_6$, and $KBF_4$; 100 to 130 mM $Na_2MoO_4$; and 0.0001 to 5 mM of a mixture comprising $Na_2SO_4$ and $Na_2S_2O_3$.

In any or all of the above embodiments, the composition comprises 0.125 M $Na_2MoO_4$; 0.0502 M of a mixture comprising $K_2ZrF_6$, NaF, and $KBF_4$; and 0.03001 mM of a mixture comprising $Na_2SO_4$ and $Na_2S_2O_3$.

In any or all of the above embodiments, the composition further comprises 1 to 15 mM of a redox oxidizing component that comprises a permanganate species, a perchlorate species, a pertechnetate species, a perrhenate species, or a vanadate species.

In any or all of the above embodiments, the composition further comprises $1\times10^{-3}$ to $5\times10^{-2}$ mM $X_3Fe(CN)_6$, wherein X is a counterion selected from potassium, sodium, hydrogen, lithium, rubidium, or cesium.

Also disclosed herein are embodiments of a coated object, comprising: an object comprising a top surface; and a conversion coating formed on the top surface of the object that covers or substantially covers the top surface of the object, wherein the conversion coating comprises one or more of $MoO_2$, $Mo_2O_5$, $MoO_4^{2-}$, and $MoO_3$ and exhibits an $I_{corr}$ value ranging between 0.0020 $\mu A/cm^2$ and 0.01 $\mu A/cm^2$.

In any or all of the above embodiments, the conversion coating comprises an outer layer comprising Mo(VI) and Mo(V) and an inner layer comprising Mo(IV).

In any or all of the above embodiments, the conversion coating exhibits anodic inhibition.

In any or all of the above embodiments, the object comprises aluminum, magnesium, iron, or an alloy of aluminum, magnesium, and/or iron, or any combination thereof.

In any or all of the above embodiments, the conversion coating does not comprise chromium.

In any or all of the above embodiments, the conversion coating has an open circuit potential of −500 to −750 mV versus an Ag/AgCl standard reference electrode.

In any or all of the above embodiments, the conversion coating has an open circuit potential of −520 to −700 mV versus an Ag/AgCl standard reference electrode.

In any or all of the above embodiments, the conversion coating exhibits repassivation within 60 seconds after damage to the substrate.

In any or all of the above embodiments, the conversion coating is formed from the composition of any or all of the above composition embodiments.

In any or all of the above embodiments, the conversion coating is formed directly on the top surface of the object.

Also disclosed herein are embodiments of a coating, comprising: one or more of $MoO_2$, $Mo_2O_5$, $MoO_4^{2-}$ and $MoO_3$; fluorine ions; and ions formed from a redox oxidizing component, or sulfur ions, or a combination of ions formed from a redox oxidizing component and sulfur ions.

In any or all of the above embodiments, the coating is made from a composition according to any or all of the above composition embodiments.

In any or all of the above embodiments, the ions formed from the redox oxidizing component are permanganate ions, perchlorate ions, pertechnetate ions, perrhenate ions, vanadate ions, and any combination thereof.

Also disclosed herein are embodiments of a method for making an object comprising a conversion coating, comprising:

exposing an object to a composition according to any or all of the above embodiments for a time period sufficient to form a conversion coating on one or more surfaces of the object; and removing the coated object from the composition to provide the object comprising the conversion coating, wherein the conversion coating comprises one or more layers comprising one or more of $MoO_2$, $Mo_2O_5$, $MoO_4^{2-}$ and $MoO_3$.

In any or all of the above embodiments, the object comprises aluminum, magnesium, iron, or an alloy of aluminum, magnesium, and/or iron, or any combination thereof.

In any or all of the above embodiments, the conversion coating does not comprise chromium.

VIII. Examples

Materials:

Large sheets of aluminum alloy AA2024-T6 having the composition listed in Table 1, were cut into coupons that measured 1.5 cm×1.5 cm. The coupons were polished to a finish of 1 μm by wet polishing using a copper-free Buehler Metadi diamond suspension solution.

TABLE 1

Analysis of aluminum alloy 2024-T6.

| Component | Wt. % |
|---|---|
| Al | 90.7 to 94.7 |
| Cr | Max 0.1 |

TABLE 1-continued

Analysis of aluminum alloy 2024-T6.

| Component | Wt. % |
|---|---|
| Cu | 3.8 to 4.9 |
| Fe | Max 0.5 |
| Mg | 1.2 to 1.8 |
| Mn | 0.3 to 0.9 |
| Si | Max 0.5 |
| Ti | Max 0.15 |
| Zn | Max 0.25 |
| Other, each | Max 0.05 |
| Other, total | Max 0.15 |

Coating solutions were made using varying amounts of ferricyanide, hexafluorozirconate and sodium molybdate and in one embodiment the ferricyanide was replaced with titanium dioxide. Stock solutions were made using these three species by combining each one separately with deionized water. Twenty-five (25) mL of each solution was then mixed to get the desired concentration. After the solutions were combined together, 1 M $HNO_3$ was added until the pH was lowered to 1.5. This mixture was left overnight to equilibrate prior to use as a coating bath.

The polished samples were degreased using isopropanol and placed in a tissue wetted with DI water for 10 minutes prior to exposure to the coating solution. The sample remained submerged in the solution until a uniform coating was formed. The coating time for the formation of molybdate coatings is in the same range as the time taken for the formation of chromate conversion coatings, which is listed as 5-10 minutes. The coating formulation time depended in part on the composition of the coating bath. However, the majority of the samples formed a good coating at approximately 7 minutes. Once the coating was formed, the sample was removed from the bath, rinsed with DI water and blotted dry with a tissue.

A total of twelve composition embodiments were initially analyzed, with varying concentrations of the components contained within the solution. The amount of sodium molybdate in the coating formations was fixed at 25 mM. The concentrations of potassium hexafluorozirconate and potassium ferricyanide were varied, as described in Example 1 below.

Characterization of Coating Embodiments

Electrochemical Analysis:

Each of the twelve compositions of Example 1 were used to coat a polished aluminum alloy AA2024-T6 sample. The coated samples were exposed to a 0.05 M NaCl solution to test the corrosion resistance of each of the coatings. All electrochemical tests were conducted using a flat cell. A platinum coated niobium mesh was used as the counter electrode. All potentials were measured with respect to an Ag/AgCl reference electrode. A solution of 0.05 M NaCl was used as the corrosive media. Electrochemical tests were performed using a PC4/FAS1 and a REF 600 model potentiostat supplied by Gamry Instruments, Inc. Gamry Framework version 4.1 was used to control the potentiostat and Gamry's ECHEM analyst version 1.1 was used to analyze the data. The software was used to perform an open circuit potential (OCP) and potentiodynamic test to obtain the polarization curves. Prior to polarization, the open circuit potential was monitored until the signal stabilized in a range of +/−5 mV which took 20 s to 120 s. Polarization tests were conducted in potentiodynamic mode. Samples were polarized from −0.75 V to +2.0 V versus the OCP at a scan rate of 5 mV/s.

Repassivation:

A sample of 1 $cm^2$ area exposed to 0.05 M NaCl and the OCP was monitored. During this time the sample was scratched with a glass tip and the OCP was monitored.

Optical Microscopy:

An Olympus model PMG3 microscope connected to a computer was used to capture the micrographs of the samples before and after coating, and after corrosion studies. The magnification was maintained at 50× and the surface of the sample, the color of the coating and the number of pits created after the sample had been corroded, was observed.

Scanning Electron Microscopy:

The surface morphology of the coated samples was examined using a Hitachi S-4700 Field-Emission Scanning Electron Microscope. The scanning electron microscope was operated at a voltage of 20 keV. SEM was operated in analysis mode to provide high resolution images for these samples, as well as for the energy dispersive x-ray spectroscopy, which is included in this particular instrumentation system.

Ultraviolet-Visible Spectroscopy:

A UV-Vis spectrometer supplied by Shimadzu (model UV-2401PC) was used to analyze the coatings to confirm the presence of molybdate. A tungsten lamp was used and the studies utilized wavelengths in the range from 200 to 900 nm.

Fourier Transform-Infrared Spectroscopy:

FT-IR spectra were obtained using a Thermo Nicolet model Magna 760 FT-IR spectrometer in a grazing angle drifts mode with a gold slide as background. Data was collected from averaging 256 scans.

Raman Spectroscopy:

Raman spectra of the coated samples, uncoated samples and finely ground sodium molybdate were obtained using an Almega model with a 785 nm laser supplied by Thermo Electron Scientific Instrument Corporation. Data was collected from averaging 64 scans. High resolutions scans were collected using a 4 μm spot size and laser intensity at 10%.

X-ray Photoelectron Spectroscopy:

XPS analysis was performed using a Kratos Axis Ultra DLD. The samples were analyzed with and without sputtering, which was conducted for 1 minute with $Ar^+$. A polished Al sample, sodium molybdate and a coated sample were analyzed to determine what chemical species were present on the surface of the coated aluminum alloy AA2024-T6.

Example 1

In this example, twelve molybdate-based compositions, prepared as described above and as shown in Table 2, were applied to an aluminum substrate.

TABLE 2

Compositions 1-12 used in coating process.

| Composition | $K_2ZrF_6$ (mM) | $K_3Fe(CN)_6$ (mM) | $Na_2MoO_4$ (mM) | $TiO_2$ (mM) |
|---|---|---|---|---|
| 1 | 10 | 1.50E−02 | 25 | 0 |
| 2 | 10 | 7.50E−03 | 25 | 0 |
| 3 | 10 | 3.75E−03 | 25 | 0 |
| 4 | 10 | 0 | 25 | 0.015 |
| 5 | 5 | 1.50E−02 | 25 | 0 |
| 6 | 2.5 | 1.50E−02 | 25 | 0 |
| 7 | 1.25 | 1.50E−02 | 25 | 0 |
| 8 | 0.625 | 1.50E−02 | 25 | 0 |
| 9 | 5 | 7.50E−03 | 25 | 0 |
| 10 | 2.5 | 7.50E−03 | 25 | 0 |
| 11 | 5 | 3.75E−03 | 25 | 0 |
| 12 | 2.5 | 3.75E−03 | 25 | 0 |

Figure 1B:
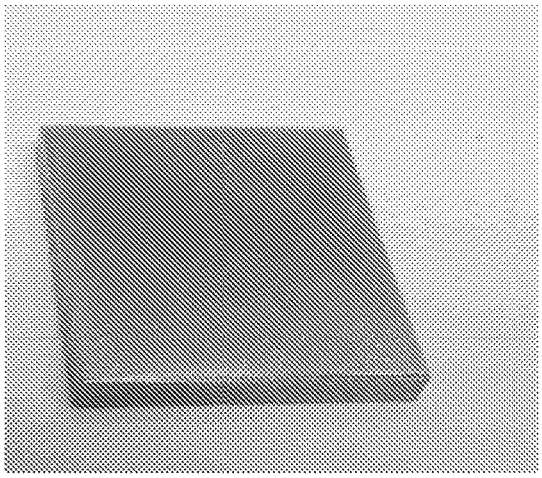

FIG. 1 shows photographs of a polished aluminum alloy AA2024-T6 substrate prior to coating (FIG. 1A), and after application of a MoCC (FIG. 1B). The different molybdate-based compositions resulted in different coating formation times and slightly different hues (some had a more purple color and others had a yellow hue indicating that the coating predominantly consisted of ferricyanide) with the majority showing a similar color to that shown in FIG. 1B.

The parameters that were considered to determine the quality of the coating are listed in Table 3. They are as follows; open circuit potential (OCP) measured in millivolts versus Ag/AgCl reference, $E_{corr}$ measured in millivolts versus Ag/AgCl reference electrode and $I_{corr}$ measured in microamperes. The difference between the OCP and the $E_{corr}$ is that the OCP values were observed by measuring the open circuit potential of the sample, and $E_{corr}$ was determined using potentiodynamic polarization experiments.

TABLE 3

Average values of corrosion resistance parameters for Compositions 1-12.

| Composition | OCP (mV vs. Ag/AgCl) | $E_{corr}$ (mV vs. Ag/AgCl) | $I_{corr}$ (μA) | $\beta_a$ (V/decade) | $\beta_c$ (V/decade) |
|---|---|---|---|---|---|
| 1 | −696 | −793 | 4.491 | 0.1663 | 0.1471 |
| 2 | −598 | −573 | 0.919 | 0.0571 | 0.0740 |
| 3 | −660 | −660 | 1.651 | 0.0464 | 0.0497 |
| 4 | −598 | −565 | 0.235 | 0.0511 | 0.0506 |
| 5 | −582 | −539 | 2.857 | 0.2518 | 0.5187 |
| 6 | −603 | −552 | 2.856 | 0.2578 | 0.2006 |
| 7 | −615 | −575 | 1.331 | 0.1172 | 0.1543 |
| 8 | −624 | −572 | 1.547 | 0.1296 | 0.3241 |
| 9 | −611 | −575 | 1.859 | 0.1367 | 0.1827 |
| 10 | −611 | −582 | 2.898 | 0.0932 | 0.2289 |
| 11 | −608 | −603 | 2.689 | 0.4905 | 0.5513 |
| 12 | −615 | −595 | 4.163 | 0.1437 | 0.3225 |

Figure 2:
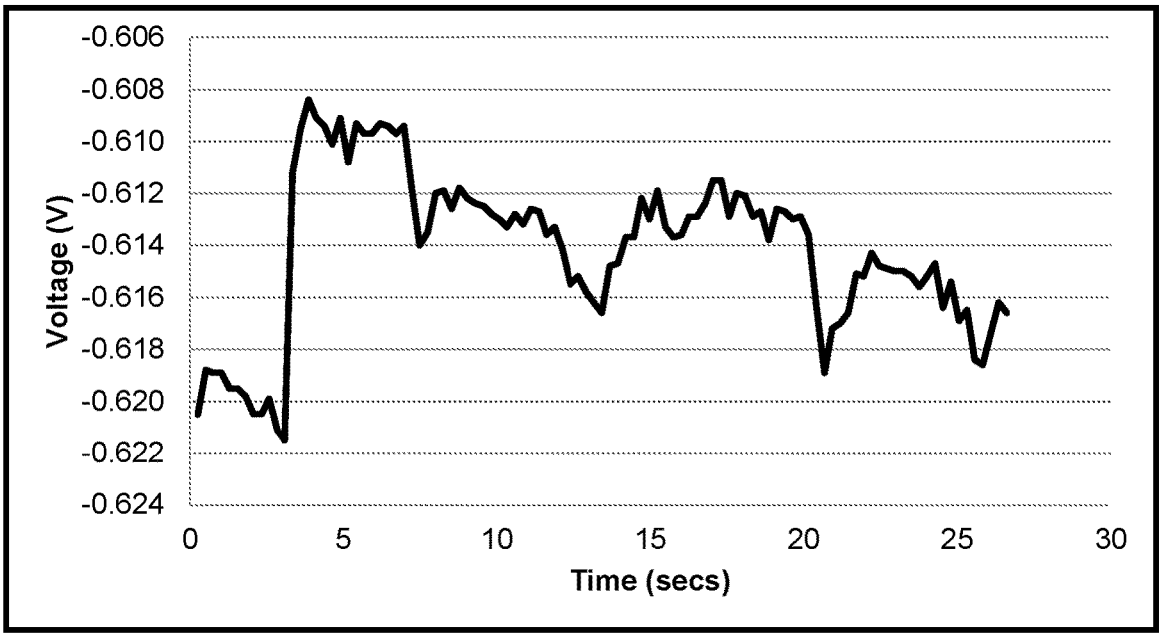
FIG. 2 is graph of voltage as a function of time, providing the open circuit potential (or "OCP") of an exemplary MoCC, as measured versus an Ag/AgCl reference electrode.

Slight variations in the measurement of OCP values can be seen in FIG. 2, which represents a typical open circuit potential graph. FIG. 2 is an OCP of an aluminum substrate coated with Composition 8, in 0.05 M NaCl using a platinum counter electrode, with potentials measured against an Ag/AgCl reference electrode. This graph shows the natural voltage of the sample in the corrosive media as a function of time. The salt solution had just been added prior to t=0 and as the experiment progressed, the signal began to stabilize around −616 mV but throughout the data acquisition period, there was always a range in which the OCP was found to fluctuate.

Tafel plots and corrosion parameters were obtained from polarization studies, and are shown below in Tables 4-15 for each set of replicates used in the testing of each specific Composition, as indicated. For each Composition, the polarization data was conducted in 0.05 MNaCl using a platinum counter electrode, and potentials were measured against an Ag/AgCl reference electrode.

TABLE 4

Data for triplicates of AA2024- T6 coated with Composition 1.

| Sample | OCP (mV) | Ecorr (mV) | Icorr (μA) | βa (V/decade) | βc (V/decade) |
|---|---|---|---|---|---|
| 1 | −600 | −550 | 5.02 | 1.82 | 0.33 |
| 2 | −680 | −698 | 4.77 | 0.08 | 0.39 |
| 3 | −700 | −712 | 1.4 | 0.02 | 0.03 |

TABLE 5

Data for triplicates of AA2024- T6 coated with Composition 2.

| Sample | OCP (mV) | Ecorr (mV) | Icorr (μA) | βa (V/decade) | βc (V/decade) |
|---|---|---|---|---|---|
| 1 | −590 | −593 | 0.384 | 0.02 | 0.02 |
| 2 | −590 | −550 | 0.0249 | 0.02 | 0.02 |
| 3 | −605 | −550 | 0.0983 | 0.01 | 0.02 |

TABLE 6

Data for triplicates of AA2024- T6 coated with Composition 3.

| Sample | OCP (mV) | Ecorr (mV) | Icorr (μA) | βa (V/decade) | βc (V/decade) |
|---|---|---|---|---|---|
| 1 | −690 | −688 | 3.26 | 0.02 | 0.08 |
| 2 | −600 | −590 | 0.874 | 0.09 | 0.04 |
| 3 | −690 | −701 | 0.82 | 0.02 | 0.02 |

TABLE 7

Data for triplicates of AA2024- T6 coated with Composition 4.

| Sample | OCP (mV) | Ecorr (mV) | Icorr (μA) | βa (V/decade) | βc (V/decade) |
|---|---|---|---|---|---|
| 1 | −595 | −565 | 0.233 | 0.03 | 0.02 |
| 2 | −595 | −590 | 0.089 | 0.02 | 0.02 |
| 3 | −605 | −540 | 0.383 | 0.09 | 0.10 |

TABLE 8

Data for triplicates of AA2024- T6 coated with Composition 5.

| Sample | OCP (mV) | Ecorr (mV) | Icorr (μA) | βa (V/decade) | βc (V/decade) |
|---|---|---|---|---|---|
| 1 | −595 | −547 | 5.25 | 0.32 | 1.15 |
| 2 | −560 | −547 | 0.15 | 0.03 | 0.04 |
| 3 | −590 | −523 | 3.17 | 0.38 | 0.36 |

TABLE 9

Data for triplicates of AA2024- T6 coated with Composition 6.

| Sample | OCP (mV) | Ecorr (mV) | Icorr (μA) | βa (V/decade) | βc (V/decade) |
|---|---|---|---|---|---|
| 1 | −605 | −568 | 6.25 | 0.60 | 0.28 |
| 2 | −600 | −532 | 2.21 | 0.14 | 0.27 |
| 3 | −605 | −556 | 0.108 | 0.02 | 0.04 |

TABLE 10

Data for triplicates of AA2024- T6 coated with Composition 7.

| Sample | OCP (mV) | Ecorr (mV) | Icorr (μA) | βa (V/decade) | βc (V/decade) |
|---|---|---|---|---|---|
| 1 | −625 | −595 | 1.01 | 0.05 | 0.12 |
| 2 | −620 | −564 | 1.38 | 0.11 | 0.14 |
| 3 | −615 | −581 | 2.13 | 0.25 | 0.21 |

TABLE 11

Data for triplicates of AA2024- T6 coated with Composition 8.

| Sample | OCP (mV) | Ecorr (mV) | Icorr (μA) | βa (V/decade) | βc (V/decade) |
|---|---|---|---|---|---|
| 1 | −615 | −571 | 2.12 | 0.16 | 0.42 |
| 2 | −635 | −571 | 0.836 | 0.07 | 0.29 |
| 3 | −625 | −566 | 1.85 | 0.20 | 0.23 |

TABLE 12

Data for triplicates of AA2024- T6 coated with Composition 9.

| Sample | OCP (mV) | Ecorr (mV) | Icorr (μA) | βa (V/decade) | βc (V/decade) |
|---|---|---|---|---|---|
| 1 | −622 | −560 | 2.19 | 0.23 | 0.22 |
| 2 | −610 | 573 | 2.59 | 0.20 | 0.27 |
| 3 | −600 | −575 | 1.66 | 0.06 | 0.10 |

TABLE 13

Data for triplicates of AA2024- T6 coated with Composition 10.

| Sample | OCP (mV) | Ecorr (mV) | Icorr (μA) | βa (V/decade) | βc (V/decade) |
|---|---|---|---|---|---|
| 1 | −610 | −549 | 1.35 | 0.07 | 0.19 |
| 2 | −625 | −600 | 2.67 | 0.05 | 0.21 |
| 3 | −600 | −592 | 5.36 | 0.12 | 0.36 |

TABLE 14

Data for triplicates of AA2024- T6 coated with Composition 11.

| Sample | OCP (mV) | Ecorr (mV) | Icorr (μA) | βa (V/decade) | βc (V/decade) |
|---|---|---|---|---|---|
| 1 | −610 | −590 | 0.377 | 1.67 | 1.81 |
| 2 | −605 | −606 | 5.48 | 0.19 | 0.22 |
| 3 | −612 | −610 | 2.45 | 0.05 | 0.08 |

TABLE 15

Data for triplicates of AA2024- T6 coated with Composition 12.

| Sample | OCP (mV) | Ecorr (mV) | Icorr (μA) | βa (V/decade) | βc (V/decade) |
|---|---|---|---|---|---|
| 1 | −610 | −591 | 1.57 | 0.08 | 0.15 |
| 2 | −620 | −606 | 6.78 | 0.23 | 0.46 |
| 3 | −610 | −595 | 3.21 | 0.11 | 0.21 |

Figure 3:
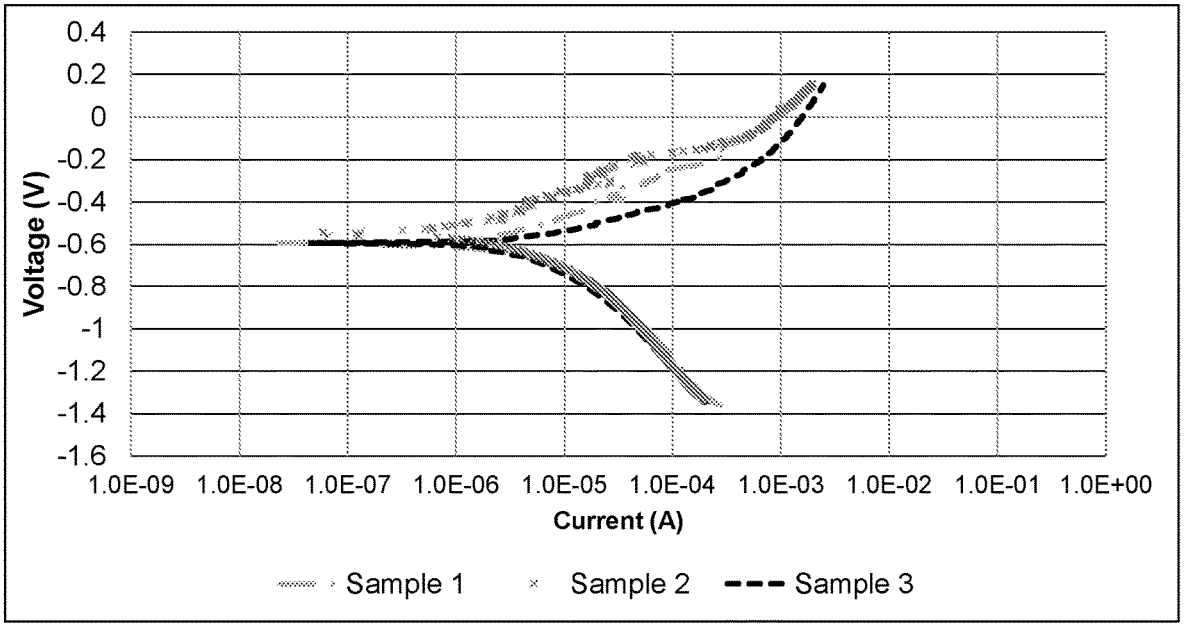
FIG. 3 is a graph of voltage as a function of current (wherein the current density as area of the electrode is 1 $cm^2$), providing the potentiodynamic polarization for triplicate samples of an exemplary MoCC, as measured versus an Ag/AgCl reference electrode.

The potentiodynamic polarization data shown in FIG. 3 is from the samples coated with Composition 2. Based on the data summarized in Table 3, Composition 4 had promising corrosion resistance parameters, however a visual inspection of the samples showed that the coating was ineffective. Specifically, after corrosion testing, the surface of the samples appeared to be stripped of the coating and displayed more pitting than any other samples. Composition 2 exhibited $I_{corr}$, values slightly higher than that of Composition 4, but the coating remained visually intact and showed fewer instances of pitting when compared to all of the other samples. The analysis of Composition 2 is shown in Table 16.

TABLE 16

Concentrations of the Components of Composition 2.

| | Concentration (mM) |
|---|---|
| $K_2ZrF_6$ | 10 |
| $K_3Fe(CN)_6$ | 7.50E−03 |
| $Na_2MoO_4$ | 25 |
| $HNO_3$ | 6.50E−02 |
| pH | ~1.5 |
| Time for solution | overnight |

Composition 2 was used as an exemplary embodiment of the MoCCs disclosed herein, and used for further analytic studies.

Aging studies were conducted to determine when the coatings are adequately aged. Chemistry of the chromate conversion coatings have been known to change with time, with a corresponding change in corrosion resistance. Typically CCCs have to be aged for at least 24 hours before they exhibit good corrosion resistance.

Figure 4:
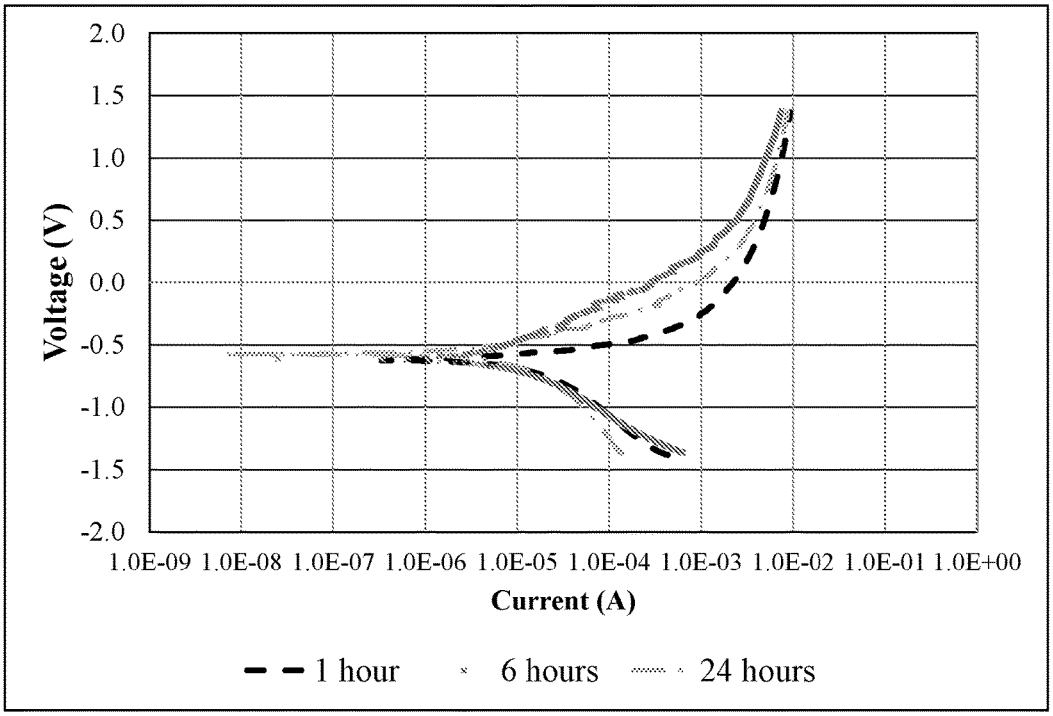
FIG. 4 is a graph of voltage as a function of current, providing the polarization for exemplary MoCCs aged for 1 hour (lines labeled "a"), 6 hours (lines labeled "b"), and 24 hours (lines labeled "c"), as measured versus an Ag/AgCl reference electrode.

FIG. 4 shows the aging process over 24 hours for triplicates of samples coated with Composition 2. The lines labeled as "a" are for samples aged for 1 hour, the lines labeled as "b" are for samples aged for 6 hours, and the lines labeled as "c" are for samples after 24 hours of aging. After 1 hour of aging, the coating appears to have the lowest corrosion resistance and after a day, the coating maintains its corrosion resistance and becomes stable, as indicated by the average corrosion current, which was determined to be 4.2 μA, 5.14 μA and 1.38 μA for 1-hour, 6-hour and 24-hour aged samples.

Figure 5:
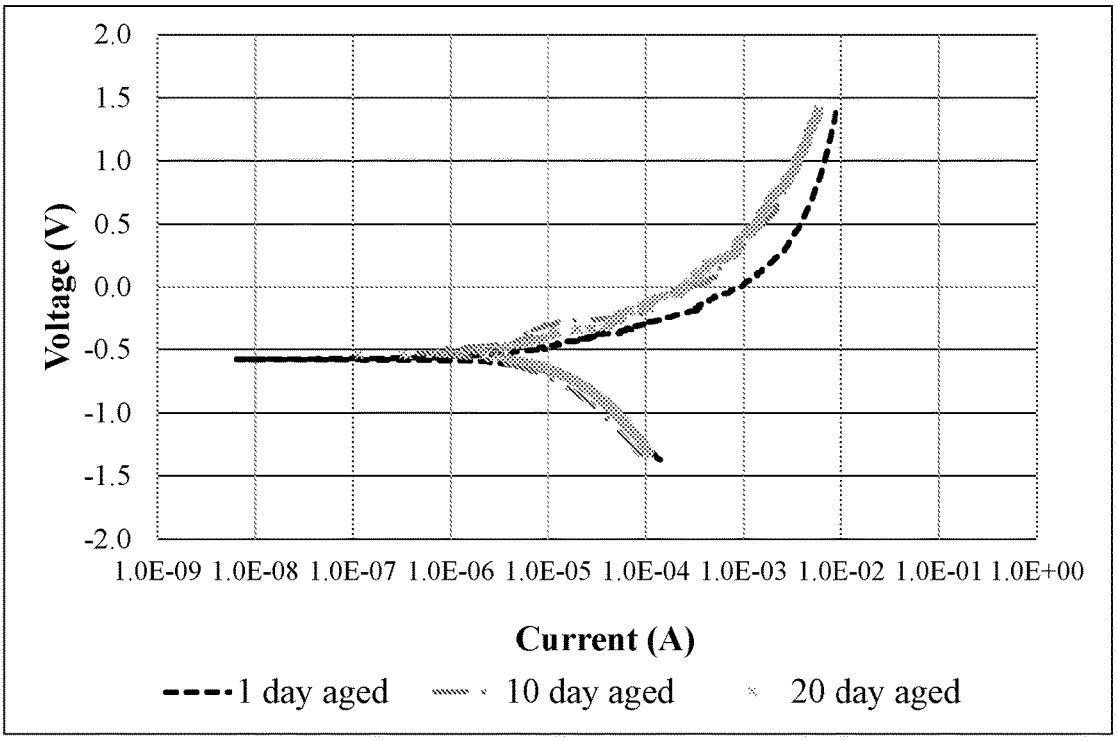
FIG. 5 is a graph of voltage as a function of current, providing the polarization for exemplary MoCCs aged for 1 day (lines labeled "a"), 10 days (lines labeled "b"), and 20 days (lines labeled "c"), as measured versus an Ag/AgCl reference electrode.

A study was conducted to determine how long the coating can be aged to obtain high corrosion resistance. FIG. 5 shows the potentiodynamic polarization data obtained for triplicates of AA2024-T6 coated with Composition 2 at various points in a long term aging process. The lines labeled as "a" are for samples aged for 1 day, the lines labeled as "b" are for samples aged for 10 days, and the lines labeled as "c" are for samples after 20 days of aging. The data shown in FIG. 5 indicates that all the samples aged after the 24 hour period show similar corrosion resistance in 0.05 M NaCl.

Figure 6:
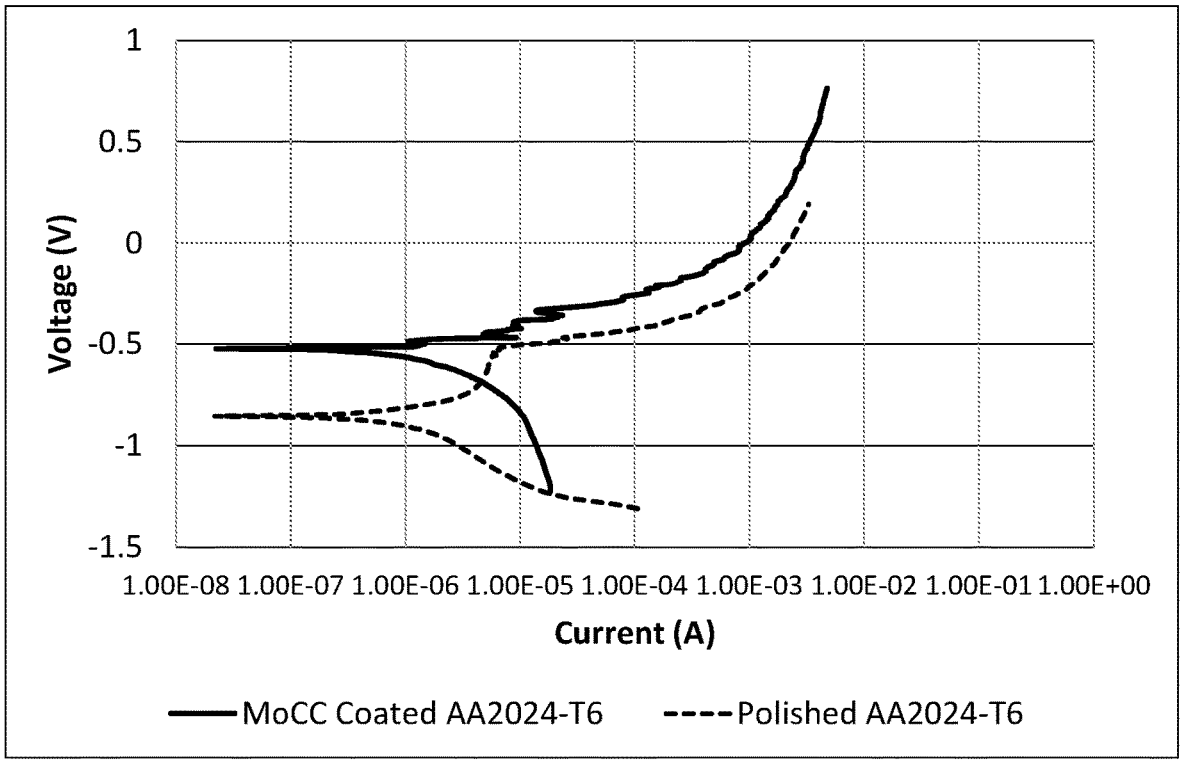
FIG. 6 is a graph of voltage as a function of current, comparing the polarization for an exemplary MoCC-coated substrate (lines labeled "a") to an uncoated aluminum alloy substrate (lines labeled "b"), as measured versus an Ag/AgCl reference electrode.

A study was conducted to determine whether the coating is protective to AA2024-T6. In the study, a sample coated with Composition 2 was compared to an as-received uncoated aluminum sample. In this example, the MoCC was aged for 24 hours. FIG. 6 shows the comparison between the two samples and confirms that the MoCC coated sample exhibits an improvement in corrosion behavior over uncoated aluminum alloy AA2024-T6, likely due in part to the ennoblement of $E_{corr}$ and the decrease in $I_{corr}$. The molybdate based coatings show a narrow region of passivity around −200 mV vs. Ag/AgCl reference electrode and also exhibit anodic inhibition.

Figure 7:
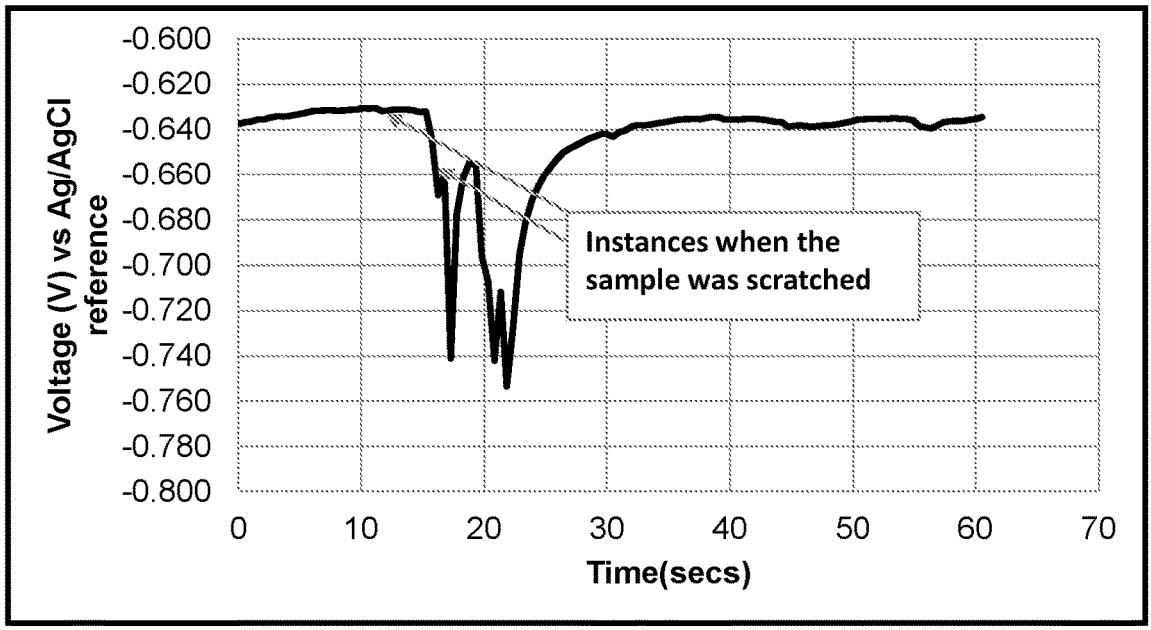
FIG. 7 is a graph of voltage as a function of time, showing the change in potential when an exemplary MoCC was scratched, indicating repassivation.

One of the properties that make CCCs particularly useful is their ability to self-heal or repassivate. In order to make a MoCC that can replace CCCs, it should display substantially the same or superior behavior. FIG. 7 shows the OCP of an AA2024-T6 sample coated with a MoCC of Composition 2 in a 0.05M NaCl solution, showing repassivation behavior following a scratch occurring at ~15 seconds. In this example, the MoCC was aged for 24 hours. During the time period the OCP was monitored, the surface of the sample was scratched to expose the more active AA2024-T6 leading to a large drop in the potential. The scratch was performed at approximately 15 seconds and again at approximately 18 seconds. The OCP data shows that the potential had risen to its original value in less than 5 seconds after scratching, indicating that the coating repaired itself and 'self-healed.' Without wishing to be bound by theory, it is currently believed that, based on the XPS results of MoCC coated samples which show similar structures as a CCC sample, the $Mo^{6+}$ ions present in the coating in the vicinity of the damaged area migrate to the damaged area to protect the coating.

Figures 8A, 8B:
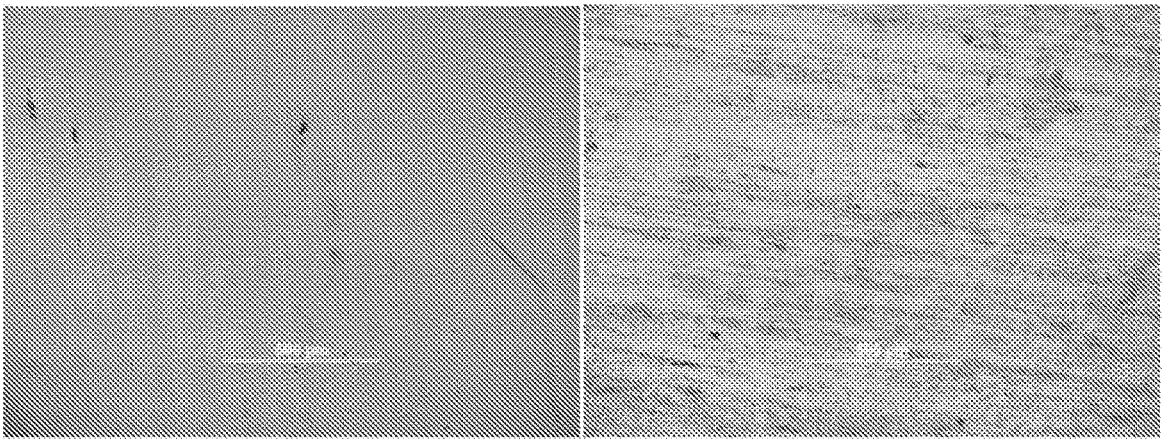
FIGS. 8A and 8B are micrographs of the surface of substrates prior to (FIG. 8A) and after (FIG. 8B) application of an exemplary MoCC; the scale bars in each image represent 500 μm.

FIGS. 8A and 8B are digital micrographs taken of the sample at different points in the coating and testing process, taken at 50× magnification. FIGS. 8A and 8B show a comparison between uncoated polished aluminum alloy AA2024-T6 (FIG. 8A) and a sample coated with Composition 2 (FIG. 8B). The coated sample shows a distinct color change due to the blue coating from the molybdate. In this example, the MoCC was aged for 24 hours.

Figure 9:
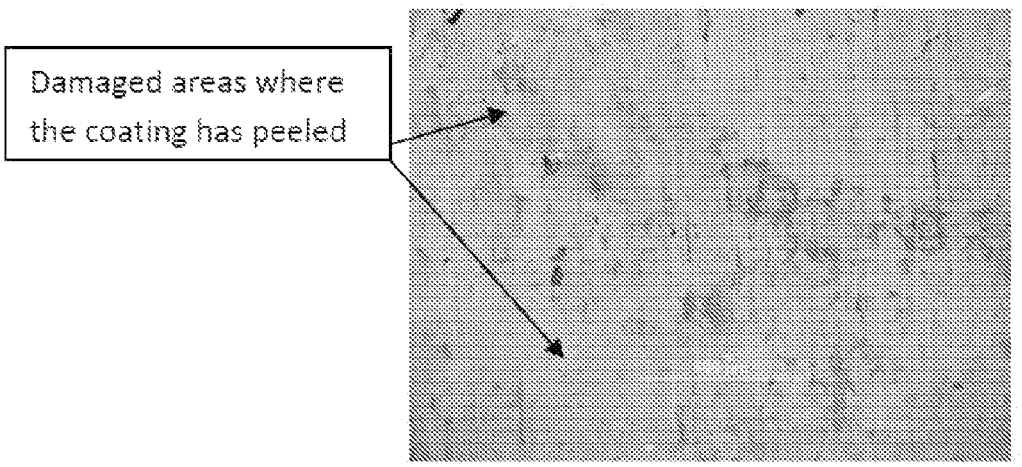
FIG. 9 is a micrograph of the surface of a substrate coated with an MoCC embodiment after electrochemical analysis; the scale bar represents 500 μm.

FIG. 9 shows the image of an AA2024-T6 sample coated with Composition 2 that has undergone electrochemical testing. In this example, the MoCC was aged for 24 hours. The extent of corrosion is evident from the image, which shows damaged areas where the coating has peeled from the substrate. The damage pointed out in FIG. 9 is thought to be a result of the pressure from the Teflon ring in the flat cell. The damage was limited to the superficial layer (whose composition is identified later) and the underlying coating remained intact.

Figure 10:
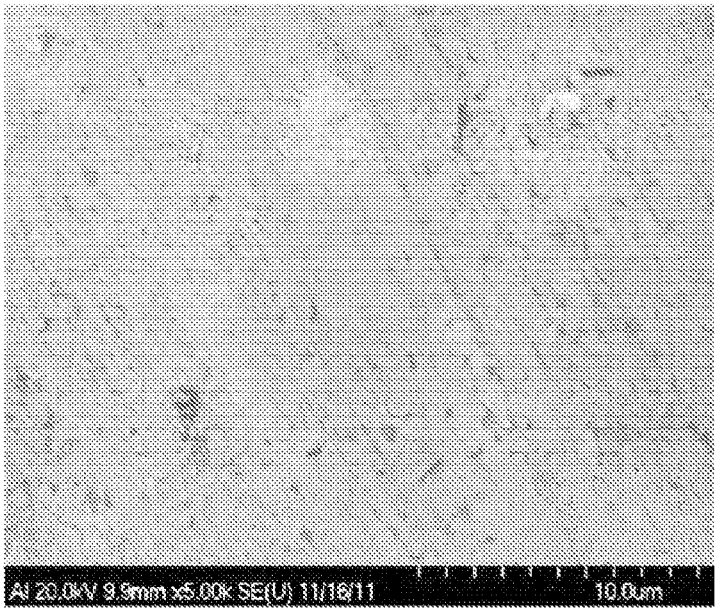
FIG. 10 is a scanning electric microscopic (SEM) image of the surface of an exemplary uncoated substrate.

Samples that were viewed using the scanning electron microscope included the following: a polished AA2024-T6 sample and an AA2024-T6 sample coated with Composition 2 before and after it had under electrochemical testing. In this example, the MoCC was aged for 24 hours. FIG. 10 is an SEM image for an uncoated polished AA2024-T6 substrate, and the intermediates can be seen in size ranging from submicron to 3 microns.

Figure 11A:
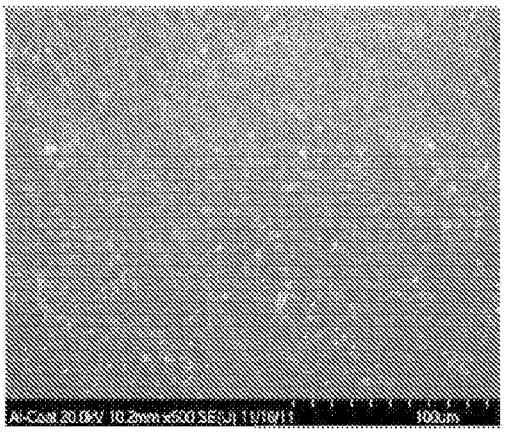
FIGS. 11A-11C are SEM images of the surface of a substrate coated with an exemplary MoCC at 500× (FIG. 11A), 1000× (FIG. 11B), and 15000× (FIG. 11C) magnification, showing the characteristic mud-cracked pattern of conversion coatings.
Figure 11B:
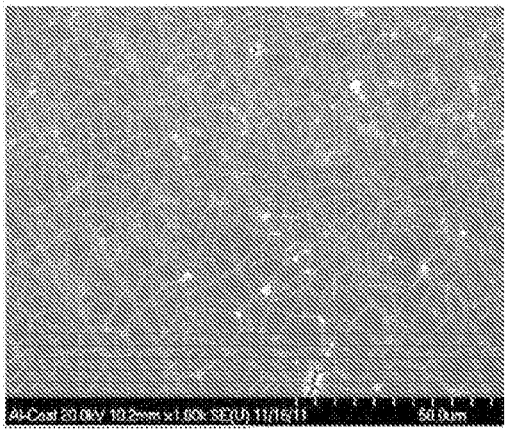
Figure 11C:
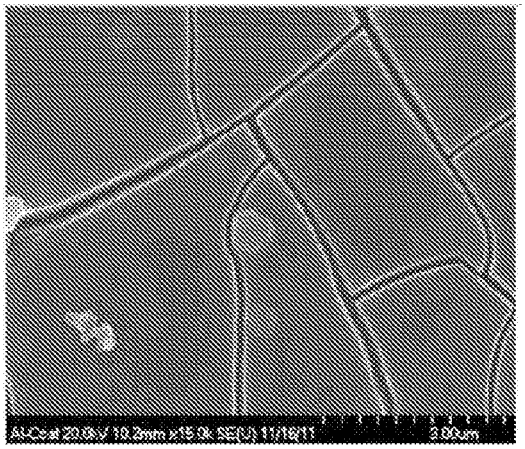

FIGS. 11A-11C show the AA2024-T6 sample coated with Composition 2 at various magnifications, indicating that a coating was formed that is in agreement with what would be expected for a protective oxide layer. Oxide layers are known to form a mud-cracked pattern, which is also indicative of a CCC. FIG. 11A is the sample at a magnification of 500×, FIG. 11B is at 1000×, and FIG. 11C is at 15000×. The mud-cracked pattern is evident at all magnification levels shown.

Figure 12A:
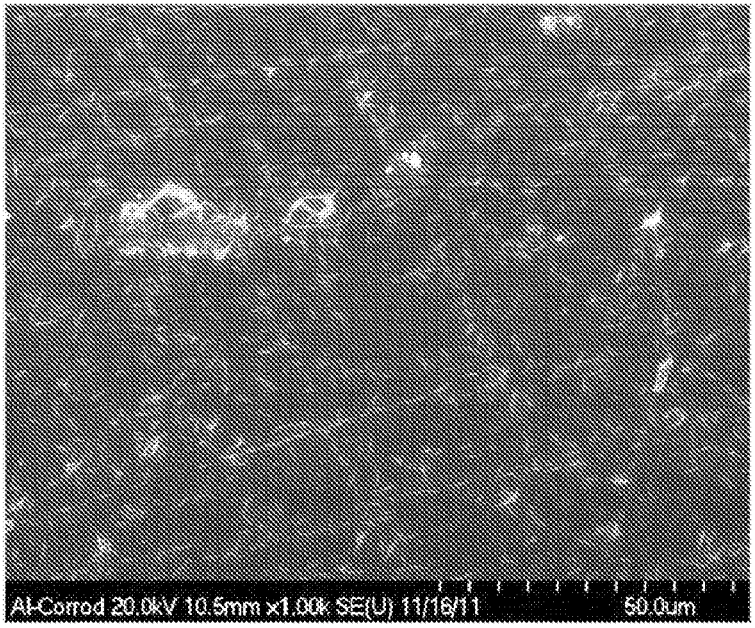
FIGS. 12A and 12B are SEM images of the surface of a substrate coated with an exemplary MoCC after electrochemical analysis, at 1000× (FIG. 12A) and 5000× (FIG. 12B) magnification.
Figure 12B:
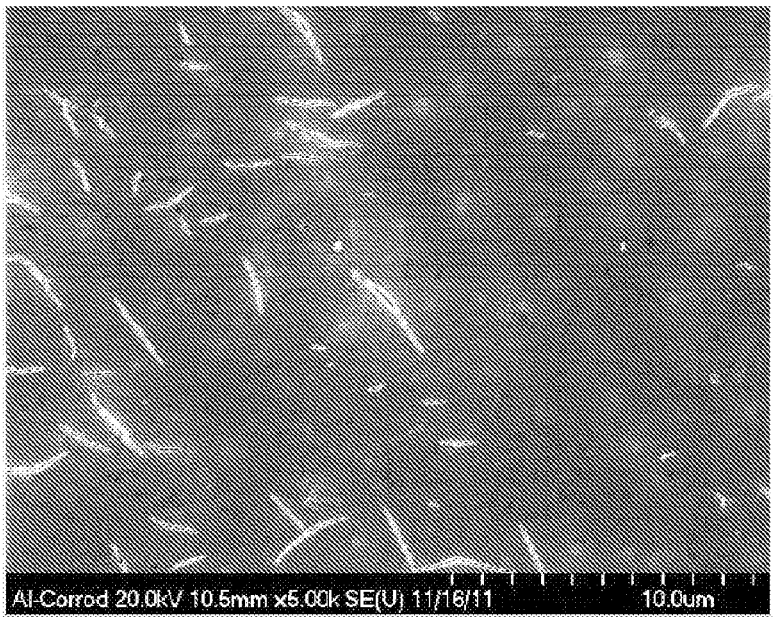

An aluminum sample that was coated with Composition 4 was subjected to electrochemical tests and this coating was considered to offer low corrosion protection. SEM imaging was performed to compare it to the coating of Composition 2. In this example, the MoCC was aged for 24 hours. The sample shown in the images of FIGS. 12A and 12B shows the surface of an AA2024-T6 sample coated with Composition 4 after electrochemical testing. FIG. 12A is at a magnification of 1000×, and FIG. 12B is at 5000×. As indicated in the images, the coating was almost entirely removed from the surface of the aluminum alloy AA2024-

T6 and looks very similar to the uncoated polished sample of AA2024-T6 in FIG. 10. The differences in the images of FIGS. 12A-B and FIG. 10 are due to the acidic conditions of the coating bath, which led to some etching of the surface during the coating procedure.

Figure 13A:
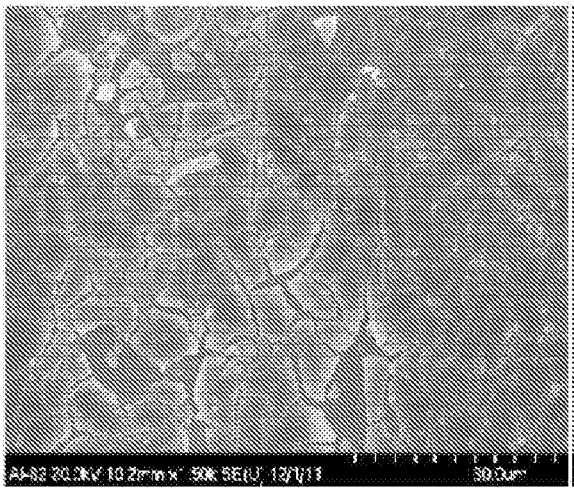
FIGS. 13A and 13B are SEM images of the surface of a substrate coated with an exemplary MoCC after electrochemical analysis, at 1500× (FIG. 13A) and 10000× (FIG. 13B) magnification.
Figure 13B:
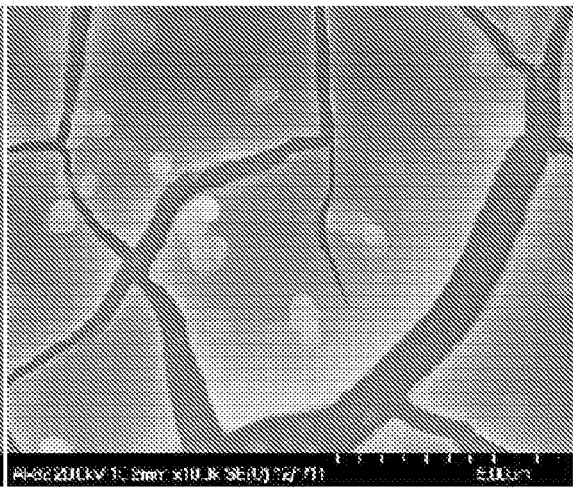

An AA2024-T6 sample that was coated using Composition 2 and had undergone corrosion testing was imaged, and the images are shown in FIGS. 13A and 13B. In this example, the MoCC was aged for 24 hours. FIG. 13A is at a magnification of 1500×, and FIG. 13B is at 10,000×. When compared to the images of FIGS. 11A-C, it is clear that the coating did sustain some damage from the exposure to the NaCl solution, but other than some minor spallation, the coating remained mostly intact. In the spots where the coating did fail, the failure was not comparable to that seen in FIGS. 12A and 12B.

The images in FIG. 12A and FIG. 13A were at magnifications of 1000× and 1500× respectively. Despite the increased magnification of FIG. 13A, the areas in which spallation did occur the surface did not appear to look like a sample that was polished or etched. Therefore, even though there appears to be a smooth surface, it is likely not due to polished aluminum and is instead likely due to an underlying dense coating that is not damaged. It is this underlying coating that forms a base layer, as discussed later.

Figure 14:
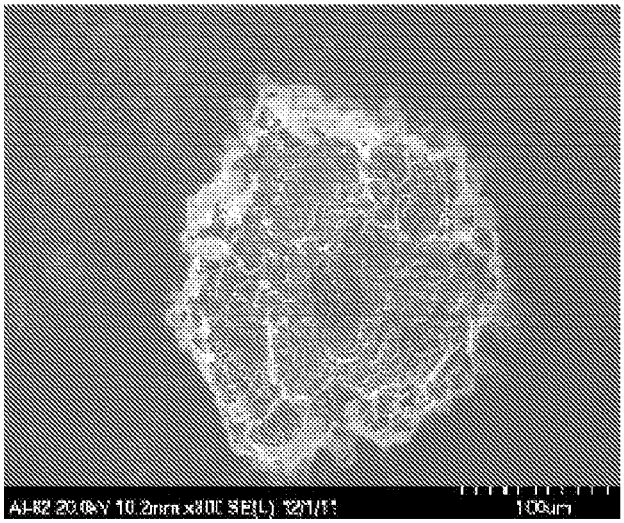
FIG. 14 is a SEM image of the substrate of FIGS. 13A and 13B, showing pitting corrosion.

Pits were found on the sample shown in FIGS. 13A-13B, and one is shown in detail in FIG. 14. Both the number and size of the pits were reduced with the sample that was coated with Composition 2 than were seen with samples that were coated with Composition 4.

Figure 15:
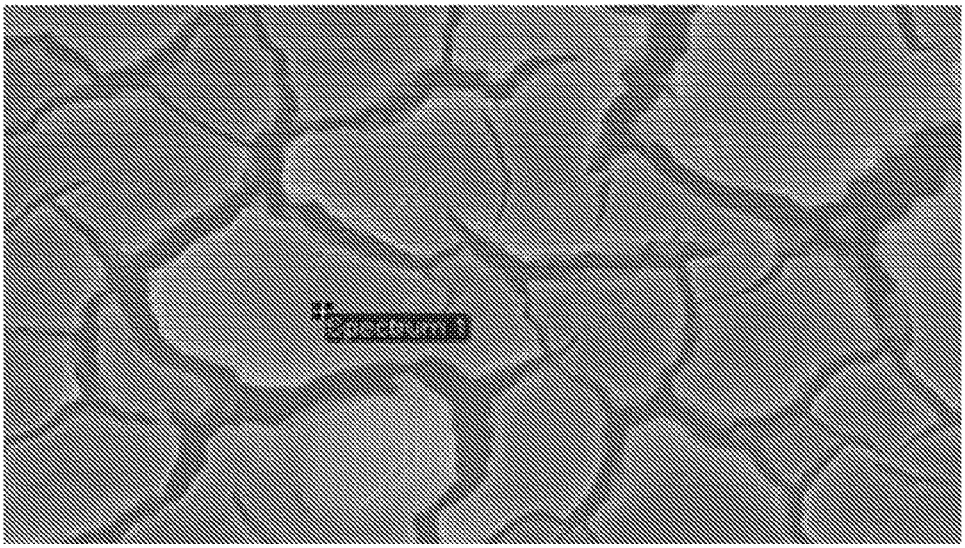
FIG. 15 is a SEM image of a representative MoCC, showing the location of the substrate comprising the coating that was analyzed by energy dispersive x-ray spectroscopy (EDS).
Figure 16:
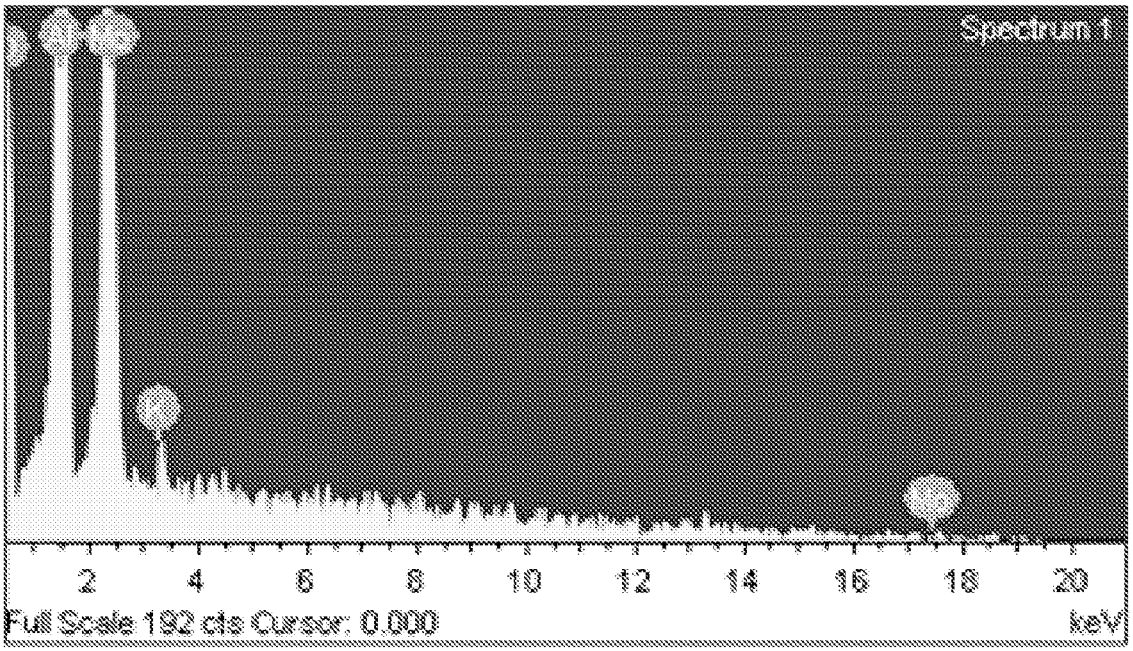
FIG. 16 is the EDS spectrum of the substrate coated with an exemplary MoCC at the location shown in FIG. 15.

The composition of the MoCC formed with Composition 2 on the aluminum substrate was also analyzed using energy dispersive x-ray spectroscopy (EDS). The location of the coated sample where the EDS spectrum was obtained, is shown in the SEM of FIG. 15, and the EDS spectrum is shown in FIG. 16. The results from the spectrum are summarized in Table 17. The results indicate that a molybdenum oxide layer was successfully formed on the surface of the aluminum alloy.

TABLE 17

Analysis of the MoCC made using Composition 2 by EDS.

| Element | Weight % | Atomic % |
|---|---|---|
| O | 17.56 | 30.53 |
| Al | 61.22 | 63.11 |
| Mo | 0.5 | 6 |
| K | 20.71 | 0.35 |

Figure 17:
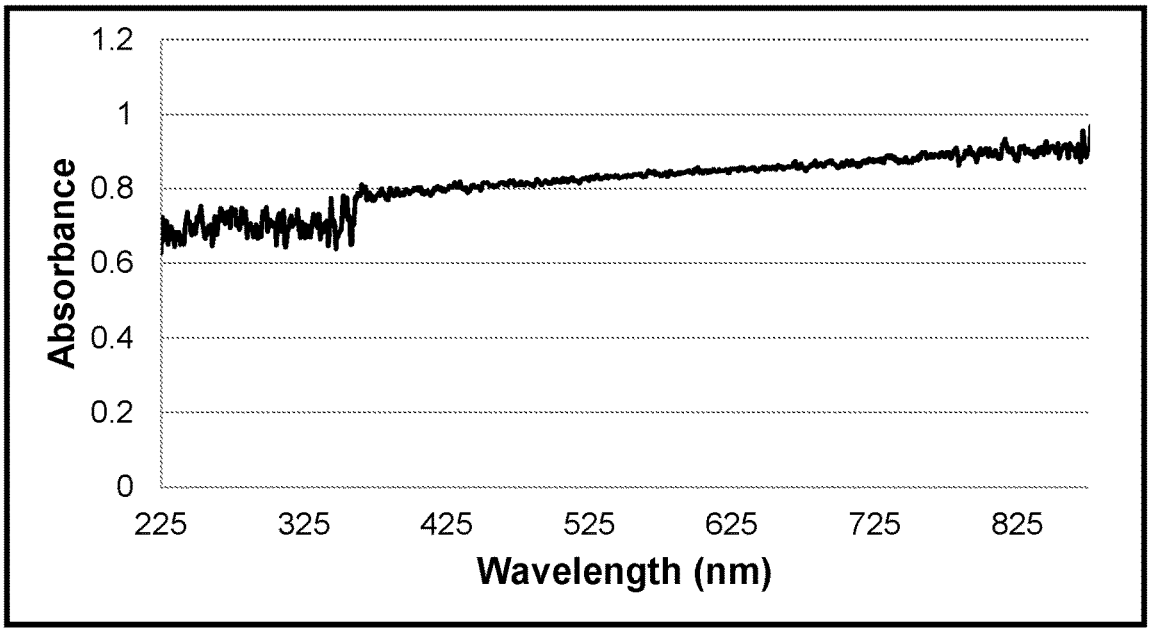
FIG. 17 is a graph of absorbance as a function of wavelength of the surface of an uncoated substrate, for use as a baseline spectrum, measured using ultraviolet-visible (UV-Vis) reflectance spectroscopy.

UV-Vis reflectance spectroscopy was used to determine the chemical species present on the surface of the AA2024-T6 samples. For all scans, the first and last 25 nm showed significant noise, however, the compounds of interest do not exhibit any peaks in those regions. Consequently, they have been omitted from the spectra shown. A sample of polished AA2024-T6 with no coating was used as a baseline for comparison, and that spectrum is shown in FIG. 17.

Figure 18:
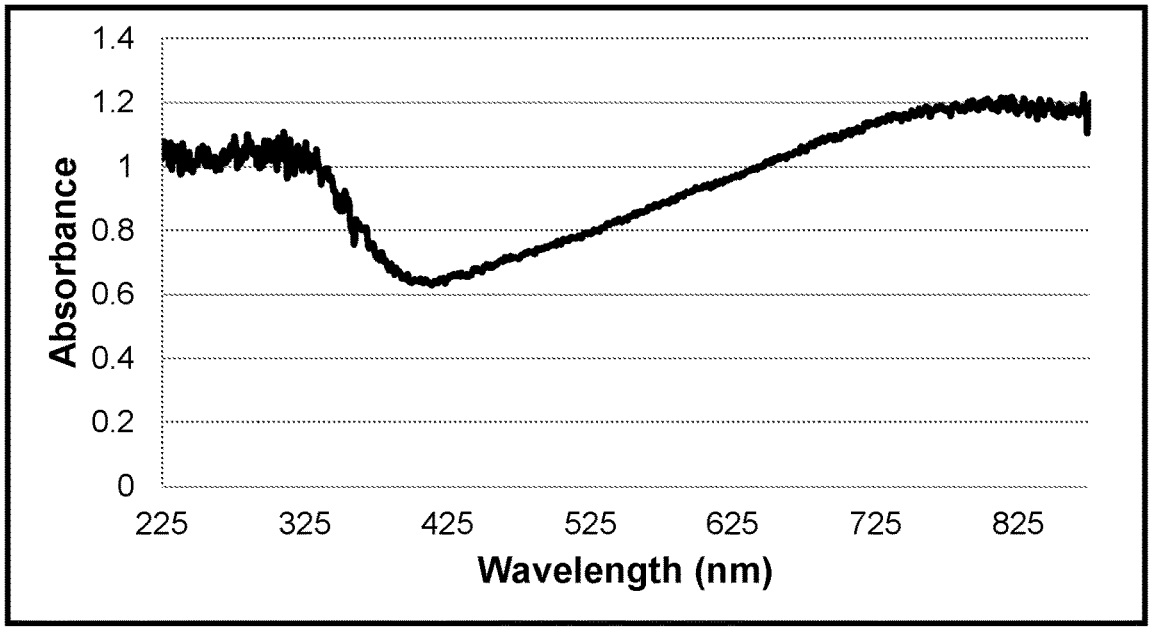
FIG. 18 is a graph of absorbance as a function of wavelength, measured using UV-Vis reflectance spectroscopy, of a substrate coated with an exemplary MoCC.
Figure 19:
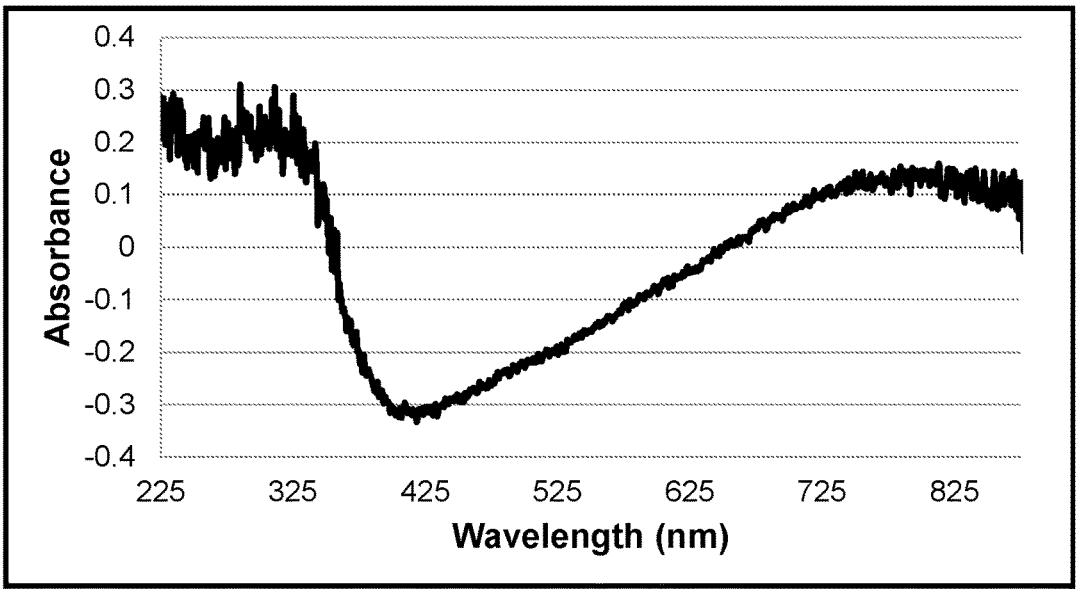
FIG. 19 is a graph of the normalized data from FIG. 17 subtracted from the normalized data from FIG. 18, indicating that the peak of FIG. 18 results from the molybdenum-containing species present in the exemplary MoCC and not the underlying substrate.

FIG. 18 shows the spectrum for the coated AA2024-T6 sample. A strong absorption band is observed from about 250-400 nm, which is characteristic of a $MoO_3$ peak. This result indicates that a molybdate-based coating was created on the surface of AA2024-T6. In order to confirm that the peak was not a result of the aluminum substrate, both sets of data were normalized and subtracted to create the graph shown in FIG. 19. The peak in FIG. 19 occurs at the same position as was observed in FIG. 18, which suggests that this peak is a result of the molybdate-based coating and not the underlying aluminum alloy sample or any other substance that was found on the surface of the aluminum alloy AA2024-T6 prior to coating.

FT-IR spectroscopy was conducted on three samples: (1) uncoated polished AA2024-T6, (2) a MoCC formed using Composition 2 on an AA2024-T6 substrate, and (3) finely ground sodium molybdate powder.

Figure 20:
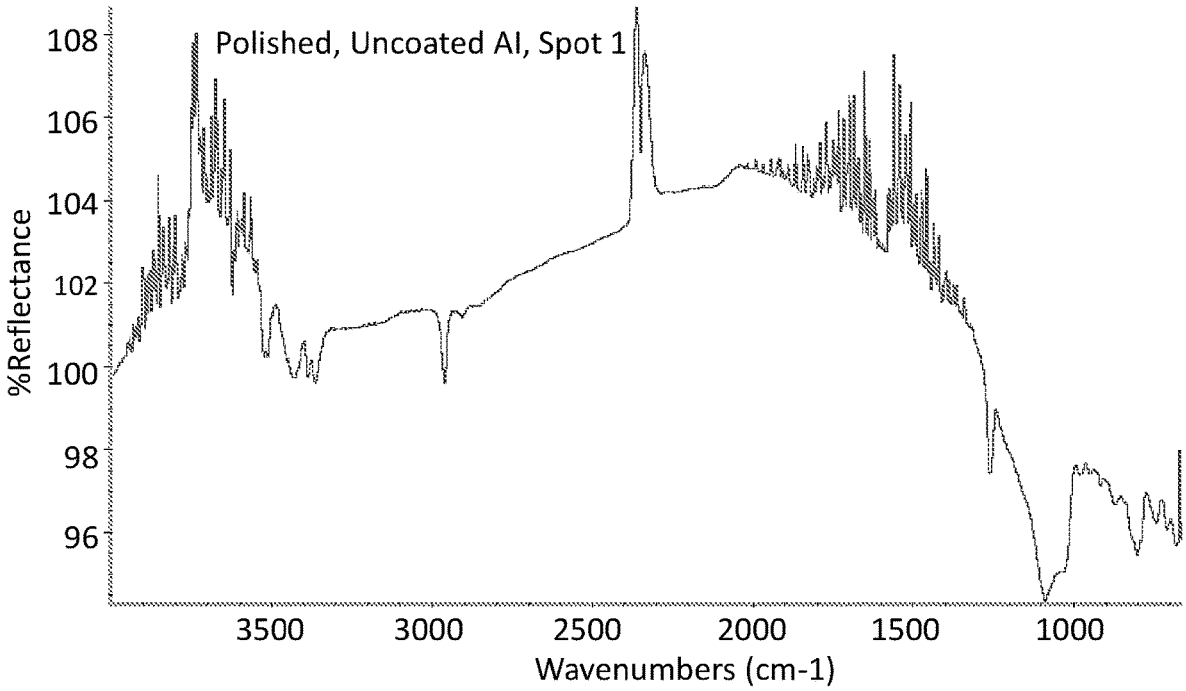
FIG. 20 is a Fourier Transform-Infrared (or "FT-IR") spectrum of the surface of an uncoated substrate, for use as a baseline spectrum, with peaks at 1260 $cm^{-1}$ and 1100 $cm^{-1}$ indicative of aluminum oxide.

FIG. 20 is the FTIR spectrum obtained from a polished AA2024-T6 sample that has not been coated with a MoCC. There are two peaks shown in this spectrum that are useful in characterizing the surface of the MoCC coated AA2024-T6, and those peaks occur at ~1260 $cm^{-1}$ and 1100 $cm^{-1}$. These same features are observed again in the spectrum for the MoCC coated AA2024-T6 sample (shown in FIG. 22), however they display a lower intensity than what is observed in the uncoated polished AA2024-T6. These peaks can be attributed to aluminum oxide.

Figure 21:
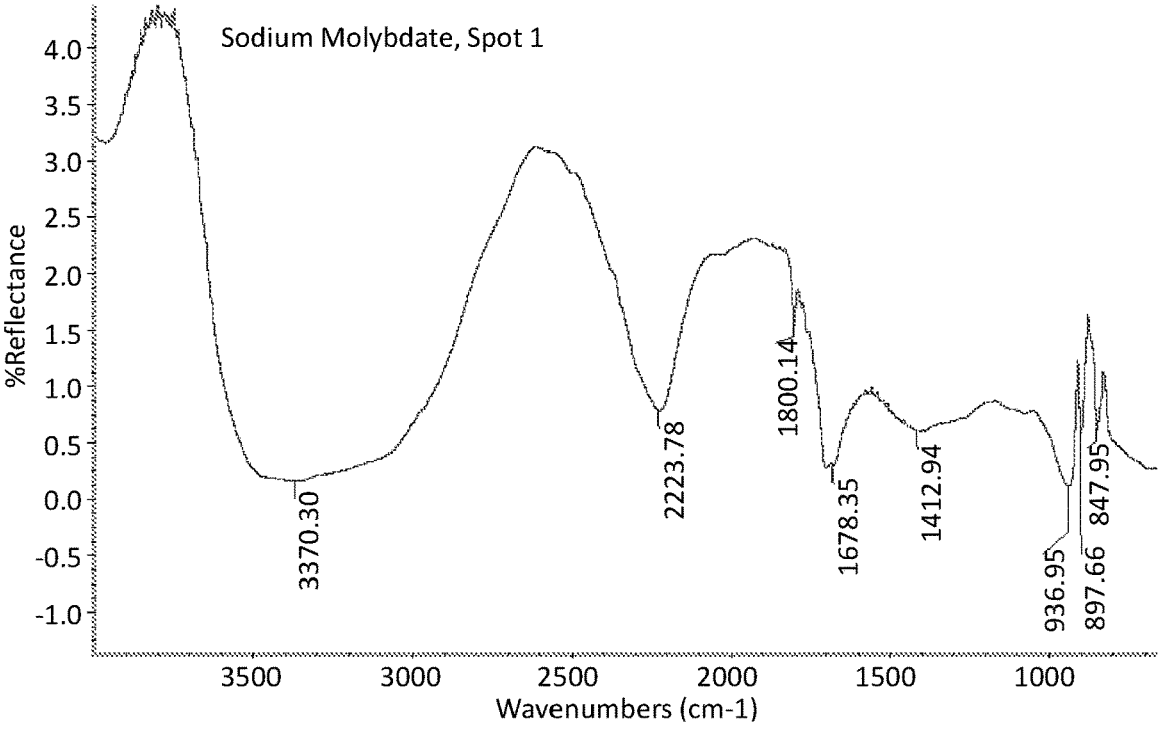
FIG. 21 is an FT-IR spectrum of sodium molybdate powder, with peaks at 1678 $cm^{-1}$, 936 $cm^{-1}$, 897 $cm^{-1}$ and 847 $cm^{-1}$ indicative of Mo—O bonding interactions.

FIG. 21 shows the FTIR spectrum from a sample of sodium molybdate powder. Features associated with the bonding interactions between Mo—O occur at 1678 $cm^{-1}$, 936 $cm^{-1}$, 897 $cm^{-1}$ and 847 $cm^{-1}$. The features observed at 2223 $cm^{-1}$ and 1412 $cm^{-1}$ are attributed to sodium and its interactions with the other species found in the coating.

Figure 22:
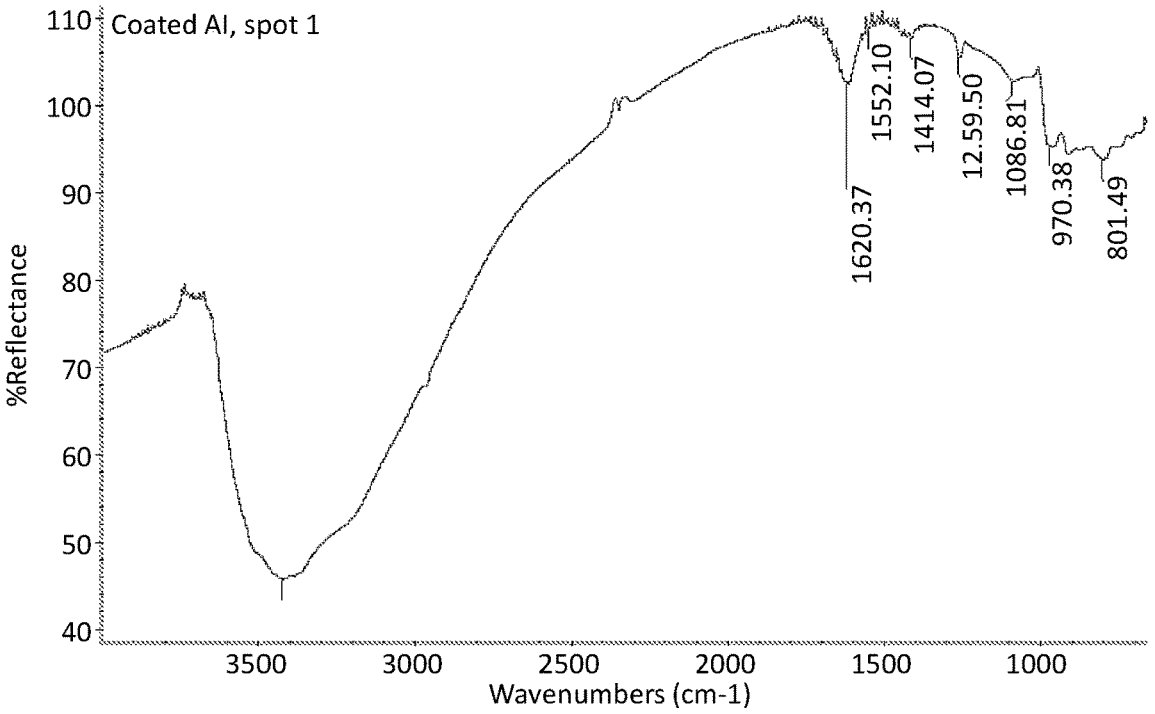
FIG. 22 is an FT-IR spectrum of a substrate coated with an exemplary MoCC, with prominent peaks observed at 1620 $cm^{-1}$, 1414 $cm^{-1}$, 1260 $cm^{-1}$, 1086 $cm^{-1}$, 970 $cm^{-1}$ and 801 $cm^{-1}$.

FIG. 22 shows the FTIR spectrum obtained from the AA2024-T6 sample that was coated with a MoCC made using Composition 2. This spectrum has prominent peaks observed at 1620 $cm^{-1}$, 1414 $cm^{-1}$, 1260 $cm^{-1}$, 1086 $cm^{-1}$, 970 $cm^{-1}$ and 801 $cm^{-1}$. The peaks at 970 $cm^{-1}$ and 801 $cm^{-1}$ are associated with molybdate and the Mo—O stretching modes, with the peak at 1620 $cm^{-1}$ also being associated with molybdate and the hydrated coating that was formed. The remaining peaks were observed in the previous spectrum and are seen less prominently likely due to a decrease in concentration in the coating when compared to the more pure compounds. The peak at 1414 $cm^{-1}$ is a result of sodium, and the peaks at 1260 $cm^{-1}$ and 1086 $cm^{-1}$ are identified as aluminum oxide.

Figure 23:
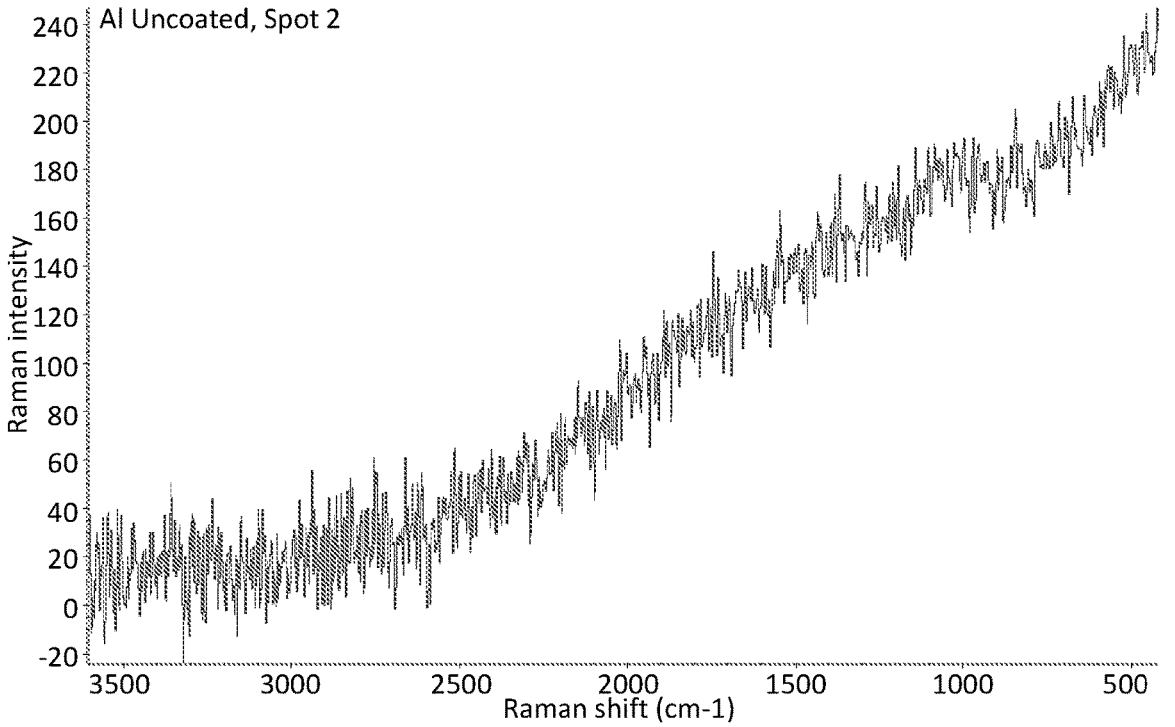
FIG. 23 is a Raman spectrum of the surface of an uncoated substrate, with no identifiable features present.

Raman spectroscopy was also conducted on three samples: (1) uncoated polished AA2024-T6, (2) a MoCC formed using Composition 2 on an AA2024-T6 substrate, and (3) finely ground sodium molybdate powder. FIG. 23 shows the spectrum from the uncoated AA2024-T6 sample, and no identifiable features are present.

Figure 24:
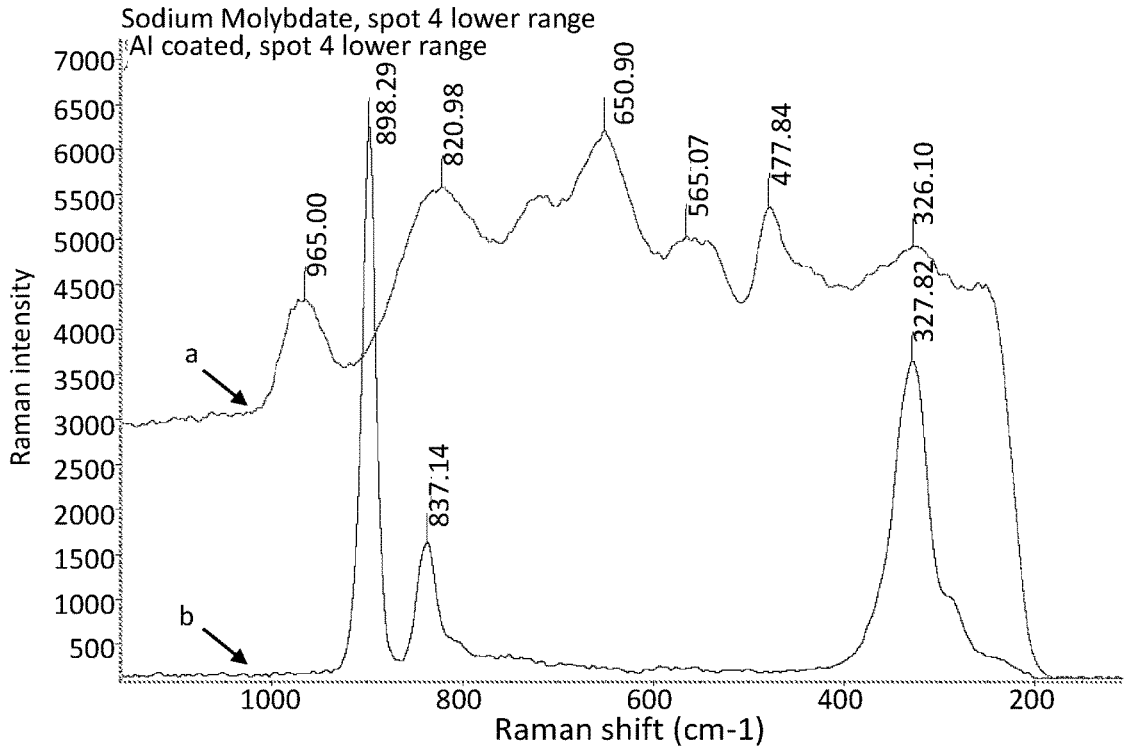
FIG. 24 shows the Raman spectra of a substrate coated with an exemplary MoCC (line labeled "a") and sodium molybdate powder (line labeled "b"); this spectra confirms that the sodium molybdate powder is not just pasted on the substrate, but rather forms a different chemical entity resulting in features different than the sodium molybdate powder.

FIG. 24 shows the spectra for the sodium molybdate powder in the lower trace (trace b) and the MoCC formed using Composition 2 on AA2024-T6 in the upper trace (trace a). Multiple peaks are identifiable in FIG. 24. In trace a, peaks of interest are located at 965, 820, 650, 565 and 477 ($cm^{-1}$) wavenumbers. These peaks fall into a range that has been associated with different bonding structures for molybdates. Hydrated molybdate coatings are known to exhibit features in the range of 940 to 960 $cm^{-1}$. The peak in trace "a" at 965 $cm^{-1}$ is close to this range, and it is assumed that a shift of 5 $cm^{-1}$ had occurred. Based on the position of the other peaks and reported literature values, this appears to be the case. The molybdate oxygen double bond range is 815-835 cm which fits with the observed peak at 820 $cm^{-1}$ with the proposed 5 $cm^{-1}$ shift. The peak that is displayed at 650 $cm^{-1}$ has been observed on alumina supported molybdenum catalysts and is attributed to their interaction. The last two peaks of interest fall in the range of 400-600 $cm^{-1}$ and that is where the molybdate oxygen stretching modes occur.

Figure 25:
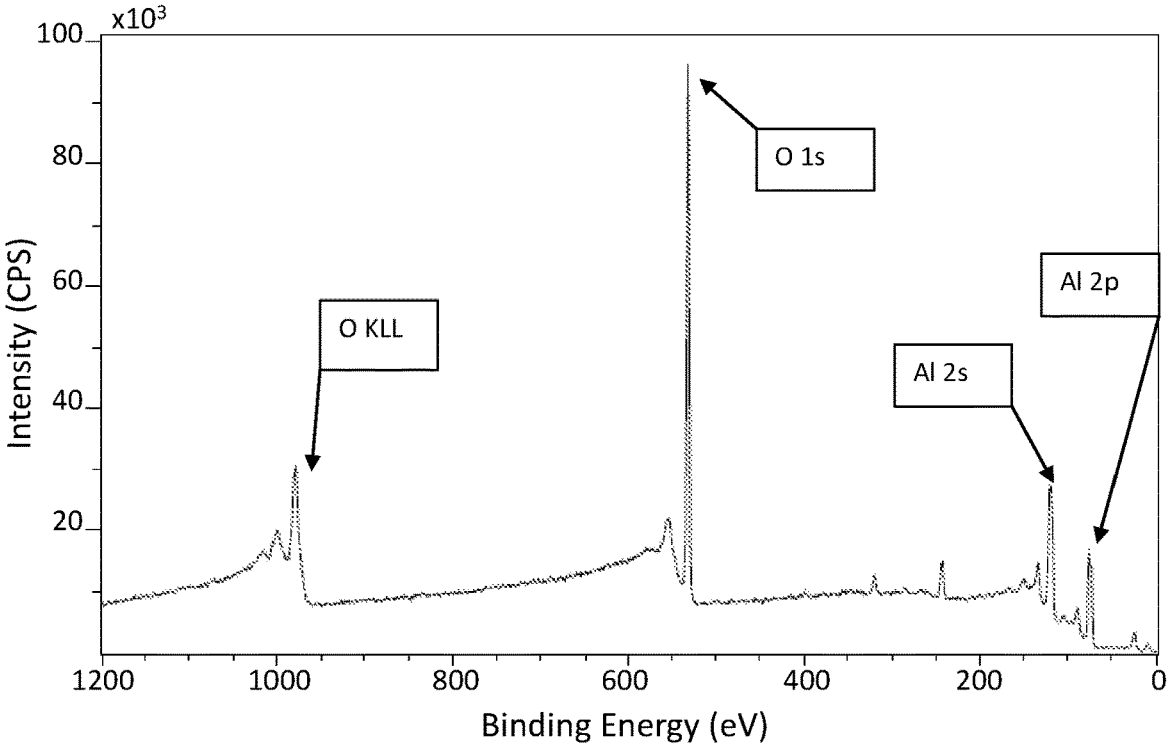
FIG. 25 is an x-ray photoelectron spectroscopic (XPS) spectrum of the uncoated substrate of FIG. 23, showing peaks indicative of aluminum oxide.

The samples that were analyzed using Raman spectroscopy were also analyzed using XPS. The XPS wide scan obtained from the uncoated polished aluminum alloy AA2024-T6 is shown in FIG. 25. Peaks are observed for Al 2p at 74 eV, Al 2s at 120 eV, O 1s at 532 eV and O KLL at about 980 eV, which are in agreement with known values. Two peaks of interest for this sample are the Al 2p and O 1s peaks, and these appeared at 74 eV and 532 eV respectively. Based on this wide scan, the composition of the analyzed region of the sample is shown in Table 18.

TABLE 18

Composition of polished aluminum alloy AA2024-T6 by XPS.

| Peak | Atomic % | Weight % |
|---|---|---|
| Na 1s | 0.1 | 0.1 |
| O 1s | 40.8 | 29.5 |
| N 1s | 0.6 | 0.4 |
| C 1s | 1.6 | 0.9 |
| Al 2p | 56.9 | 69.2 |

The samples were analyzed before and after sputtering. The sputtering depth was calculated as follows using Equation 1:

$$Z = \frac{10^9 * M * S * t * j_p}{\rho * Na * e}, \quad \text{Equation 1}$$

where

M: molar weight of the target [kg/mol]

ρ: density of the material [kg/m$^3$]

Na: $6.02\times10^{26}$/kmol; (Avogadro number)

e: $1.6\times10^{-19}$ A (electron charge)

S: sputtering yield (atom/ion)

jp: primary ion current density [A/m$^2$]

t: time (min), and z: depth of sputtering (nm).

The values used are defined in Table 19 for the ion of $Ar^+$. Based on these values, the sputtering depth was calculated to be 40 nm.

TABLE 19

Calculation of the depth removed during the sputtering process and parameters involved in the calculation.

| M(kg/mol) | ρ(kg/m^3) | S(atom/ion) | jp(A/m^2) | t(min) | z (nm) |
|---|---|---|---|---|---|
| 184 | 19.26 | 1 | 0.25 | 1 | 40 |

Figure 26:
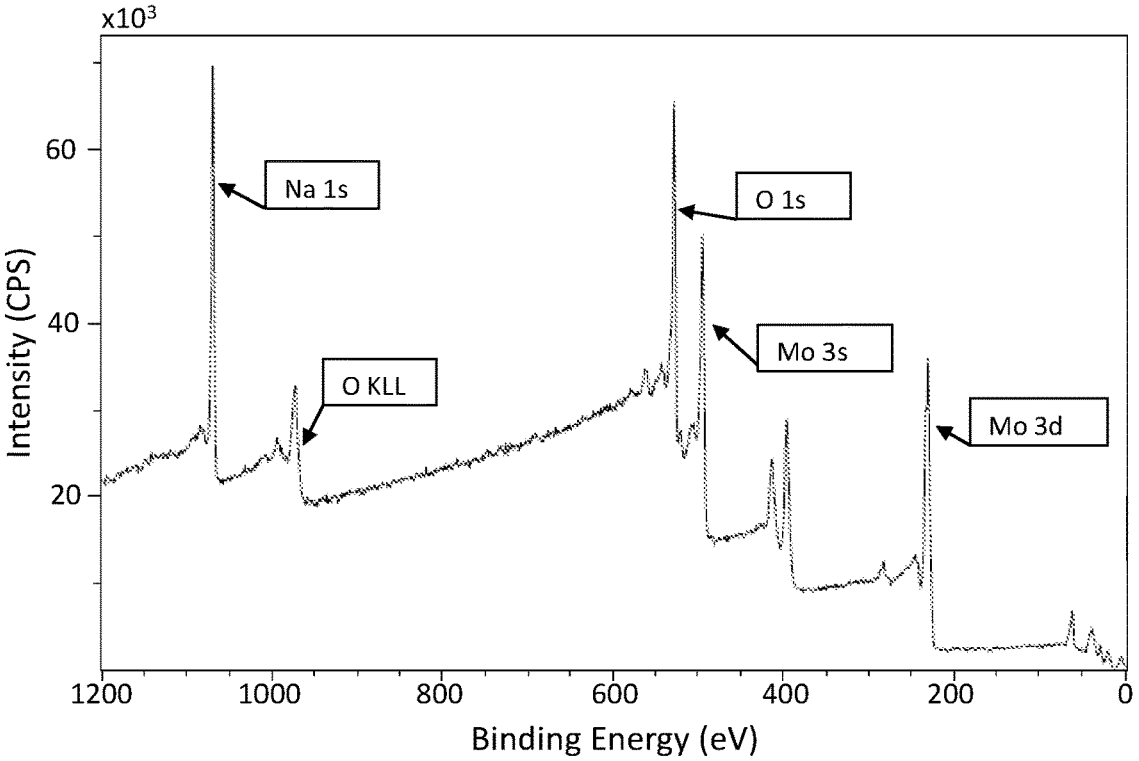
FIG. 26 is an XPS spectrum of the sodium molybdate of FIG. 24, showing the molybdenum 3d peak at 232 eV.
Figure 27:
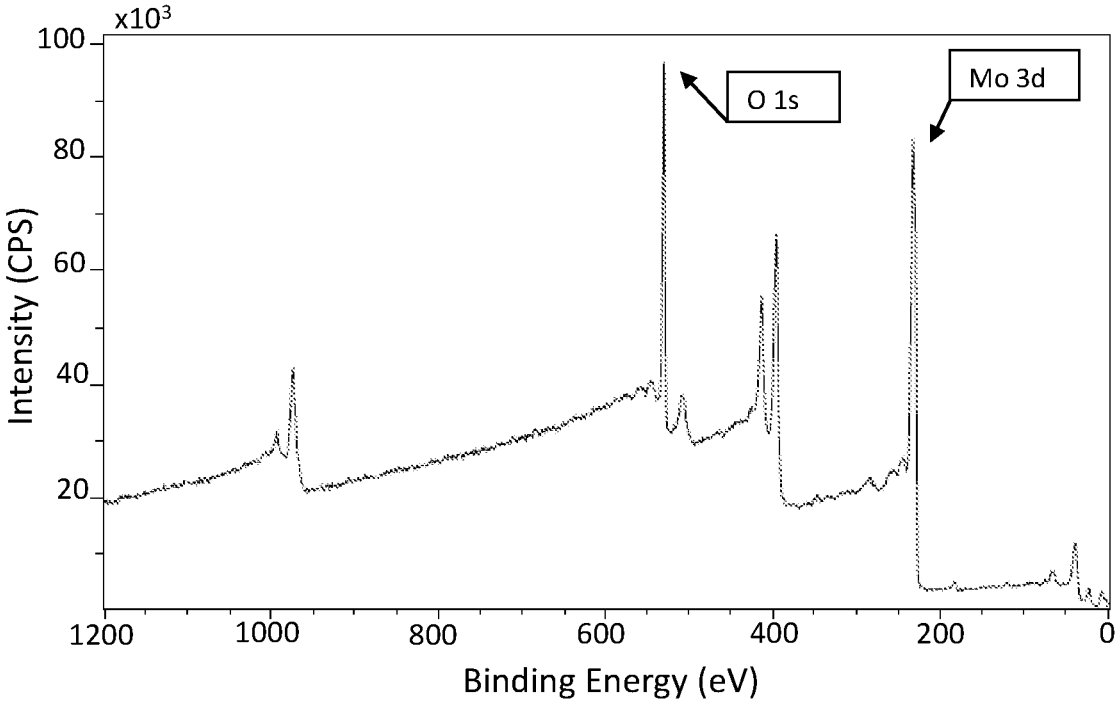
FIG. 27 is an XPS spectrum of the substrate coated with the exemplary MoCC of FIG. 24, after sputtering.
Figure 28:
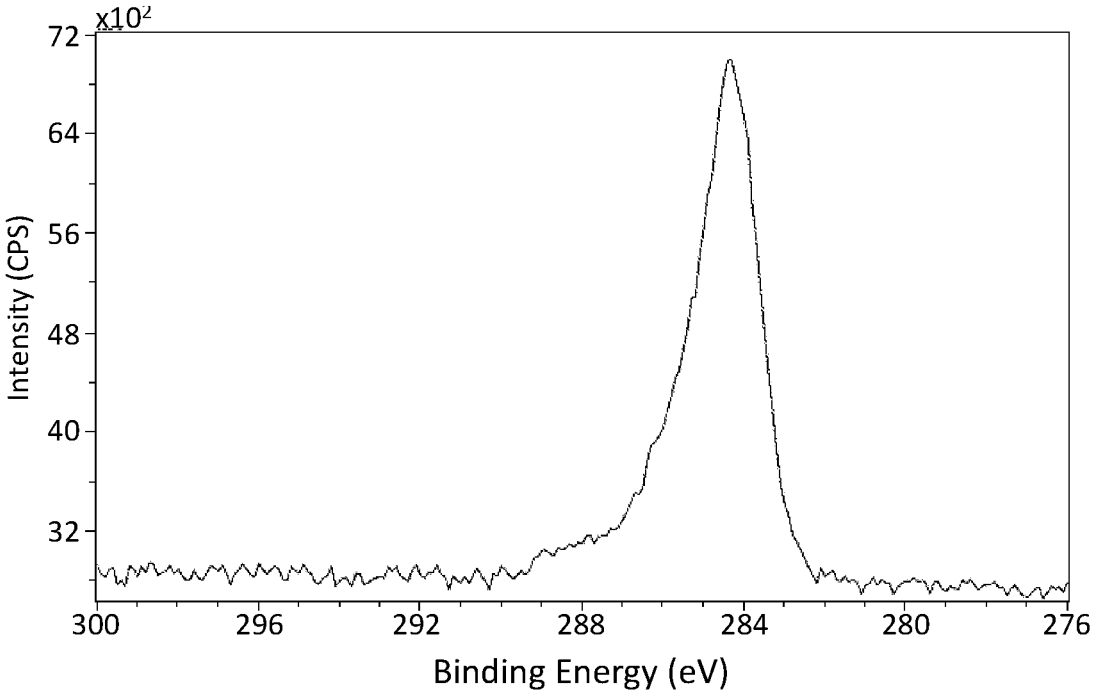
FIG. 28 is the C is region of the XPS spectrum of the substrate coated with the exemplary MoCC of FIG. 27, prior to sputtering.
Figure 29:
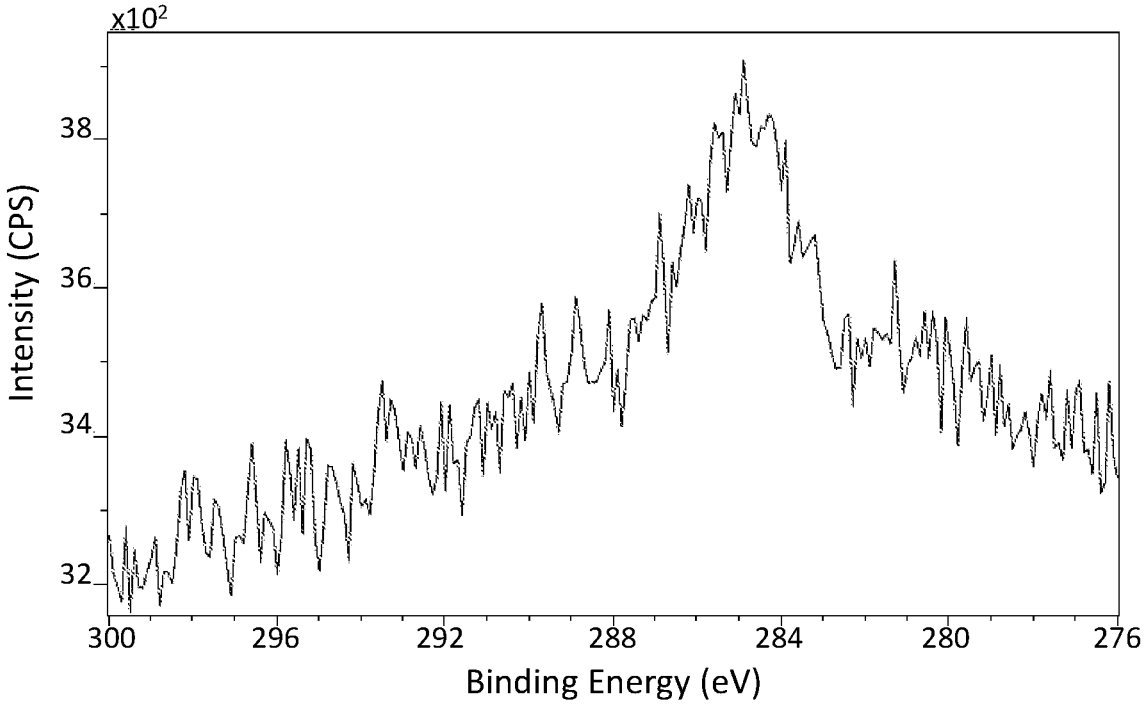
FIG. 29 is the C is region of the XPS spectrum of the substrate coated with the exemplary MoCC of FIG. 27, after sputtering.

FIG. 26 shows the XPS spectra of the wide scan for sodium molybdate with the molybdenum 3d peak at 232 eV. The XPS spectra obtained from the MoCC formed using Composition 2 on AA2024-T6 was more complex. The wide scan is shown in FIG. 27. While the characteristic peaks for oxygen and molybdenum are clearly seen, the Al 2p was not present in the scan. The wide scans taken before and after sputtering for the MoCC coated AA2024-T6 sample both show shifts for the C1s peak, which was calibrated as 284.6 eV. The narrow scans for the C is region are shown in FIGS. 28 and 29. FIG. 28 shows the C 1s spectrum obtained from the MoCC sample before sputtering, and FIG. 29 shows the C 1s spectrum obtained from the MoCC sample after sputtering. These spectra are representative of the before and after sputtering process, respectively.

Figure 30:
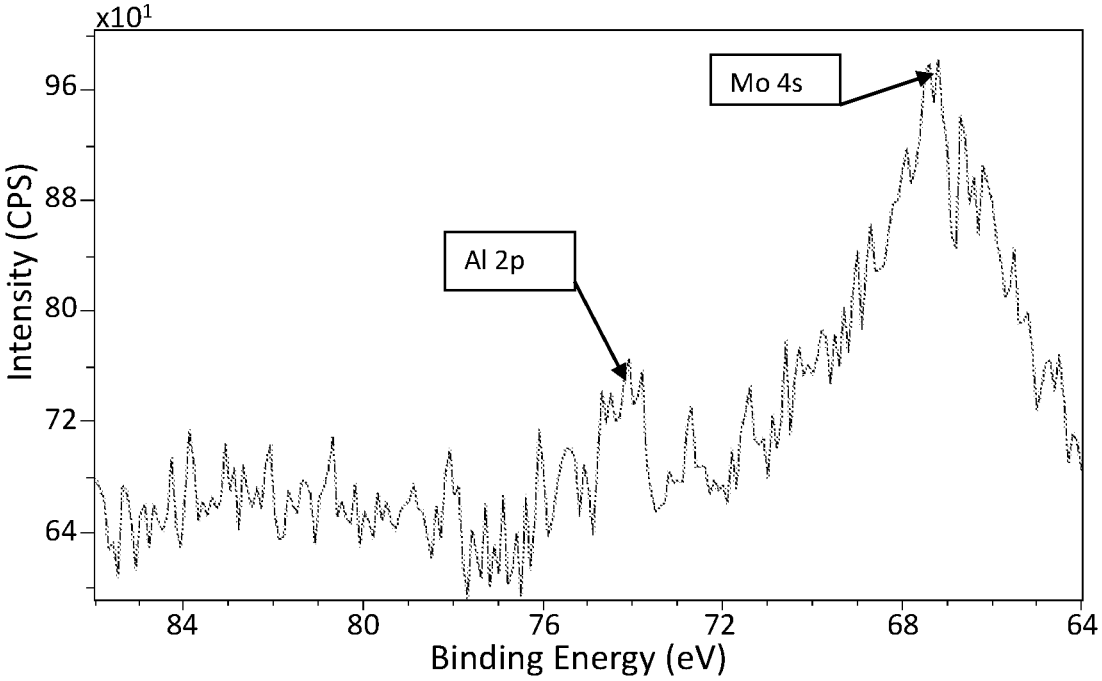
FIG. 30 is the Al 2p region of the XPS spectrum of the substrate coated with the exemplary MoCC of FIG. 27, prior to sputtering.
Figure 31:
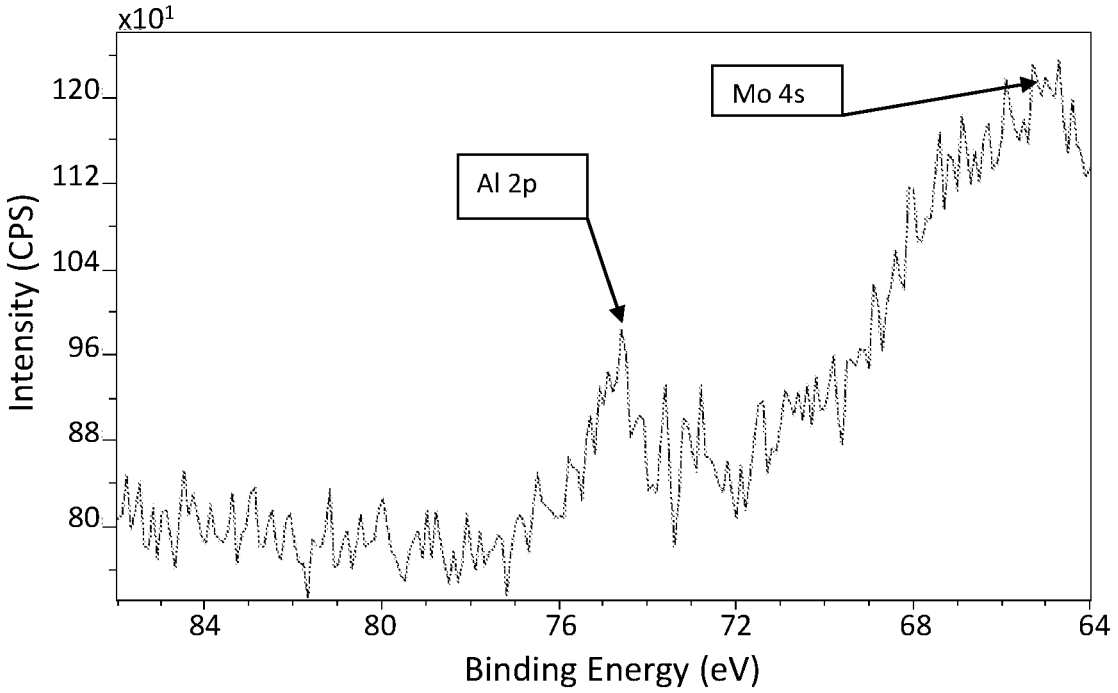
FIG. 31 is the Al 2p region of the XPS spectrum of the substrate coated with the exemplary MoCC of FIG. 27, after sputtering.

The Al 2p peak was not distinctly observed in the narrow scan performed at 65 to 86 eV, which is shown in FIG. 30 (before sputtering). Al 2p is usually observed at approximately 73 eV, and its absence can be explained as being due to the thickness of the coating and the depth of the XPS analysis. The coating is typically 100's of nm thick, while the depth of analyses of the XPS is only ~10 nm. Therefore the coating shields the underlying aluminum. FIG. 31 is the Al 2p spectrum obtained from the MoCC coated sample after sputtering. Tables 20 and 21 show the composition of the analyzed regions of the MoCC on AA2024-T6 before and after sputtering, respectively.

TABLE 20

Analysis of MoCC coated sample from XPS before sputtering.

| Peak | Atomic % | Weight % |
|---|---|---|
| O 1 | 39.9 | 23.9 |
| C 1s | 43.5 | 19.5 |
| Mo | 15.2 | 54.7 |
| Zr | 0.2 | 0.7 |
| Al | 1.2 | 1.2 |

TABLE 21

Analysis of MoCC coated sample from XPS after sputtering.

| Peak | Atomic % | Weight % |
|---|---|---|
| O 1 s | 54.1 | 18.3 |
| C 1s | 5.3 | 1.4 |
| Mo 3d | 38.5 | 78.3 |
| Zr 3d | 0.6 | 1.2 |
| Al 2p | 1.4 | 0.8 |

A difference between the two spectra is that after sputtering, a small peak is seen to start appearing where aluminum would typically be seen on a XPS spectrum. Although a peak starts appearing, it is still very small and barely above background noise. This is supported by the fact that Al 2p forms ~1.4 atomic % of the analyzed depth. The constant appearance of the aluminum shows that aluminum ions form an integral part of the MoCC coating. This indicates that the coating is a chemically formed Al—Mo composite coating. The larger broader peak at 65 eV is still observed and this peak is consistent with the 4s subshell of molybdenum.

Figure 32:
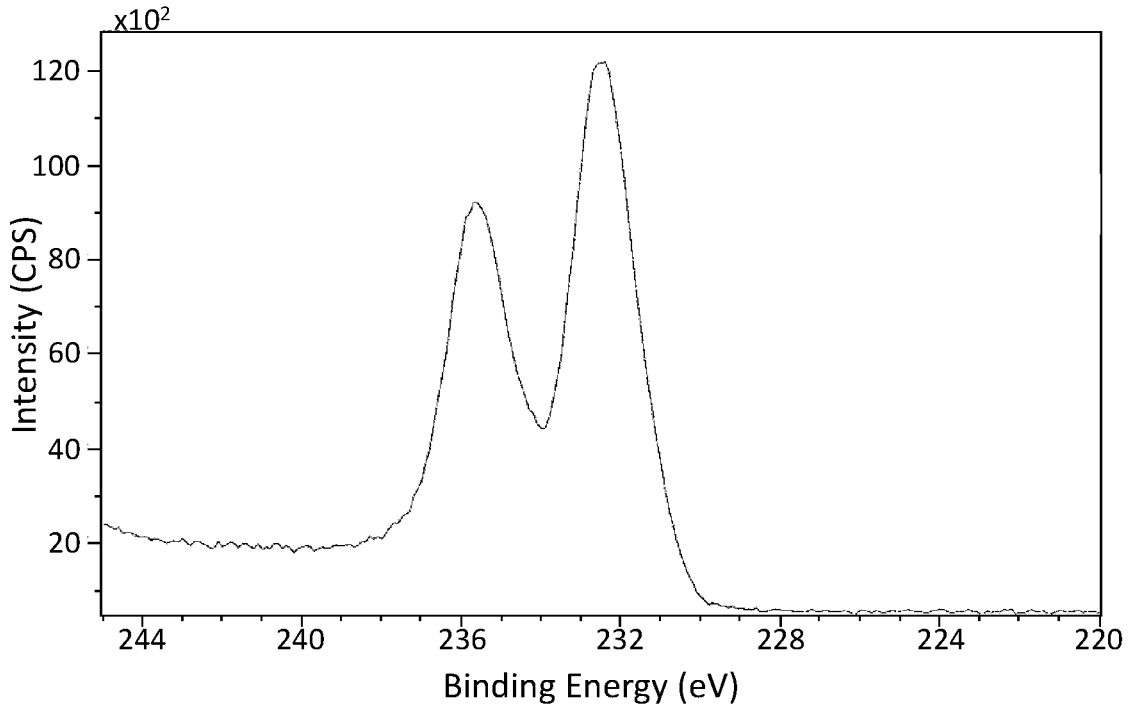
FIG. 32 is the Mo 3d region of the XPS spectrum of the substrate coated with the exemplary MoCC of FIG. 27, prior to sputtering.
Figure 33:
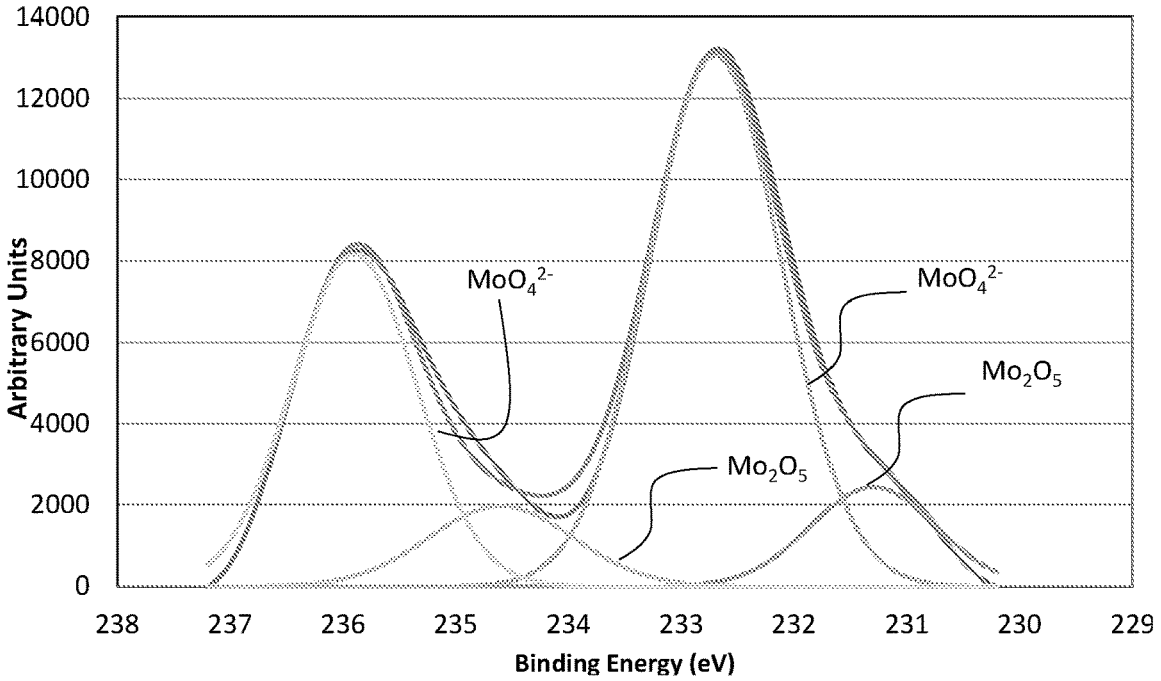
FIG. 33 is a fit of the data from FIG. 32, using smoothing and peak-fitting to differentiate the multiple peaks associated with the Mo 3d subshell.
Figure 34:
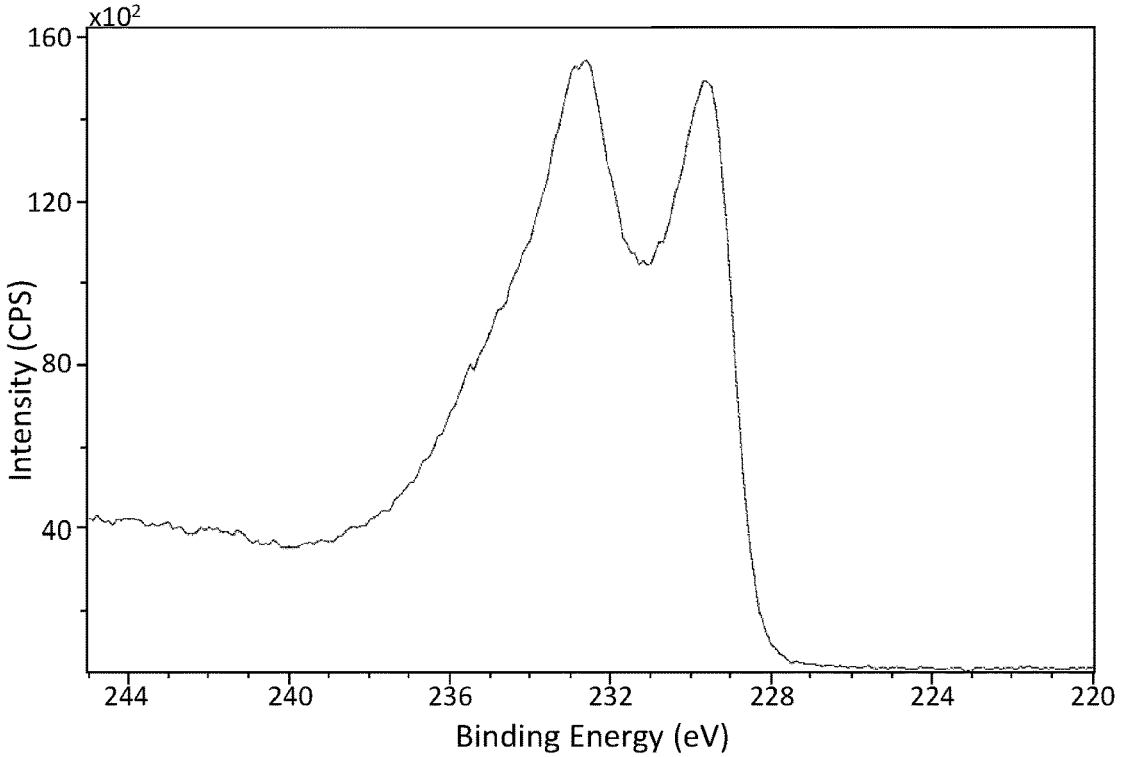
FIG. 34 is the Mo 3d region of the XPS spectrum of the substrate coated with the exemplary MoCC of FIG. 27, after sputtering.
Figure 35:
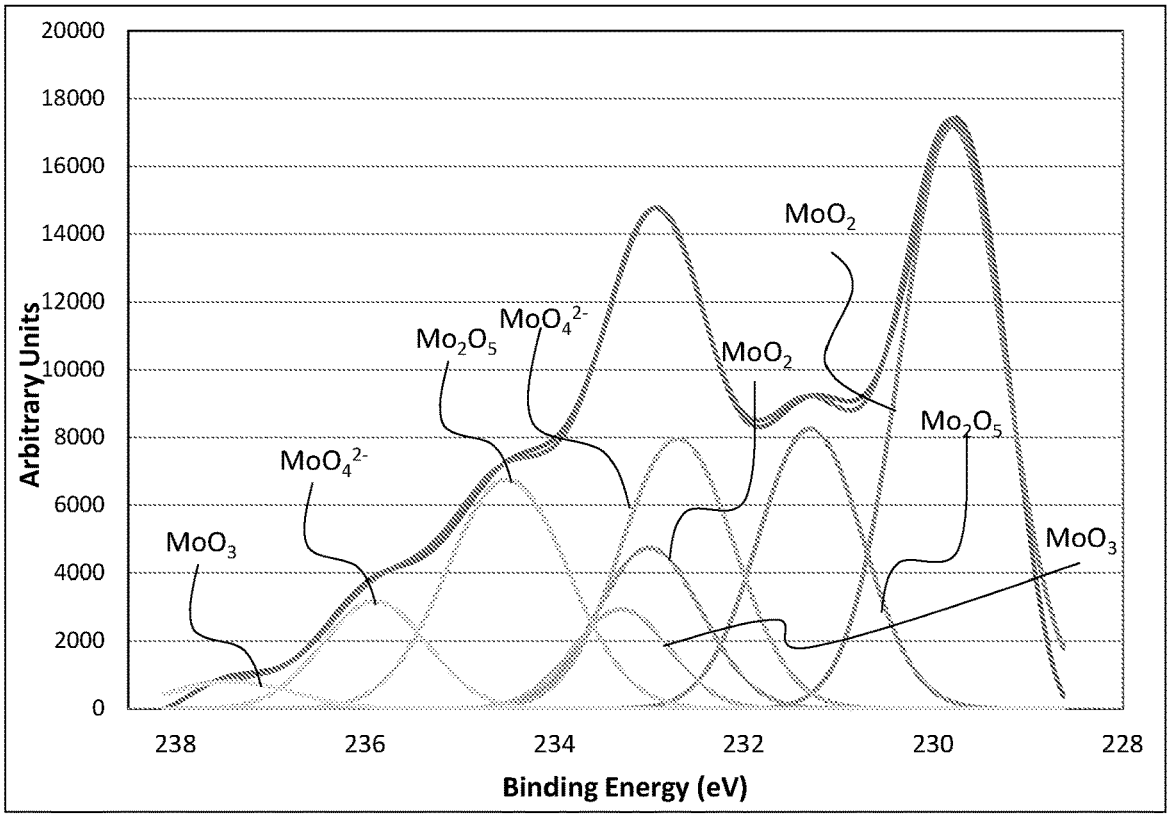
FIG. 35 is a fit of the data from FIG. 34, using smoothing and peak-fitting to differentiate the multiple peaks associated with the Mo 3d subshell.

FIG. 32 and FIG. 34 show the narrow scans in the region of molybdenum, obtained from the MoCC coated AA2024-T6 sample before and after sputtering, respectively. FIG. 32 is the Mo 3d spectrum obtained from the coated sample before sputtering, and FIG. 34 is the Mo 3d spectrum obtained from the coated sample after sputtering. There are multiple peaks associated with the molybdenum 3d subshell and to differentiate the peaks, a software program was used to identify and perform peak-fitting. The spectrum was first smoothed, then a baseline was added and peaks were added using literature values and fitted to least square method to obtain best possible fit. The fitted results are shown in FIG. 33 and FIG. 35. FIG. 33 is the fitted Mo 3d spectrum obtained from the coated sample before sputtering, and FIG. 35 is the fitted Mo 3d spectrum obtained from the coated sample after sputtering.

The summary for the peak-fitting processes are shown in Tables 22 and 23. To ensure the peak fitting was done correctly, the ratios of the areas corresponding to the j-values 5/2 and 3/2 was calculated to be 1.5, which is the value that would be expected for the 3d subshell.

TABLE 22

Summary of Molybdenum Species by XPS before sputtering.

| Mo Species | BE (eV) | Valence | Height | FWHM | Normalized Area | Relative Area % | j-values |
|---|---|---|---|---|---|---|---|
| $Mo_2O_5$ | 231.30 | 5+ | 2434.38 | 1.30 | 3743.02 | 9.00 | $3d_{5/2}$ |
| $MoO_4^{2-}$ | 232.70 | 6+ | 13044.90 | 1.40 | 21600.30 | 52.20 | $3d_{5/2}$ |
| $Mo_2O_5$ | 234.60 | 5+ | 1969.47 | 1.50 | 3494.05 | 8.40 | $3d_{3/2}$ |
| $MoO_4^{2-}$ | 235.90 | 6+ | 8155.83 | 1.30 | 12540.10 | 30.30 | $3d_{3/2}$ |

TABLE 23

Summary of Molybdenum Species by XPS after sputtering.

| Mo Species | BE (eV) | Valence | Height | FWHM | Normalized Area | Relative Area % | j-values |
|---|---|---|---|---|---|---|---|
| $MoO_2$ | 229.80 | 4+ | 17164.60 | 1.30 | 23752.60 | 32.20 | $3d_{5/2}$ |
| $Mo_2O_5$ | 231.30 | 5+ | 8254.46 | 1.30 | 11422.60 | 15.50 | $3d_{5/2}$ |
| $MoO_2$ | 233.00 | 4+ | 4726.60 | 1.30 | 6540.71 | 8.90 | $3d_{3/2}$ |
| $MoO_4^{2-}$ | 232.70 | 6+ | 7963.66 | 1.40 | 11867.90 | 16.10 | $3d_{5/2}$ |
| $MoO_3$ | 233.30 | 6+ | 2934.65 | 1.20 | 3748.60 | 5.10 | $3d_{5/2}$ |
| $Mo_2O_5$ | 234.50 | 5+ | 6753.24 | 1.50 | 10782.90 | 14.60 | $3d_{3/2}$ |
| $MoO_4^{2-}$ | 235.90 | 6+ | 3178.46 | 1.30 | 4398.38 | 6.00 | $3d_{3/2}$ |
| $MoO_3$ | 237.40 | 6+ | 800.19 | 1.50 | 1277.68 | 1.70 | $3d_{3/2}$ |

The results in Table 23 support the presence of a self-healing MoCC, since the mechanism for corrosion protection for CCCs involves $Cr^{6+}$ and $Cr^{3+}$, with $Cr^{3+}$ providing a barrier for protection and the $Cr^{6+}$ responsible for the self-healing ability that is exhibited by a CCC. Another result indicative of the MoCC showing CCC-like characteristics is that the spectra showed different compositional makeup prior to and after the sputtering process. Before sputtering, the results indicated that on the surface the species present are oxidized $Mo^{5+}$ and $Mo^{6+}$. After sputtering, approximately 40 nm were removed from the surface and this resulted in the observation of reduced $Mo^{4+}$, which was not seen originally. These results are similar to CCCs in which the surface layer is composed of predominantly oxidized $Cr^{6+}$ and the base layer is composed of mostly reduced $Cr^{3+}$ Since there are multiple valence states of molybdenum present in this sample, the same mechanism proposed for the self-healing behavior of CCCs is likely active in the self-healing behavior of MoCC that was shown in FIG. 7.

The peak that is shown at 235.9 eV in FIG. 35 can be assigned to $Al_2(MoO_4^{2-})_3$ since the reported value is 235.8 eV; this value fits with the data after accounting for a shift due to the difference in the position of the C is peaks. This is also useful for the creation of a coating that is suitable as a replacement for CCCs, since it has been shown that a chromium oxide will form a compound with aluminum. Such a compound has been thought to be another reason for the corrosion protection that CCCs provide for aluminum substrates. The binding energies listed in Tables 22 and 23 were identified using known literature values.

Figure 36:
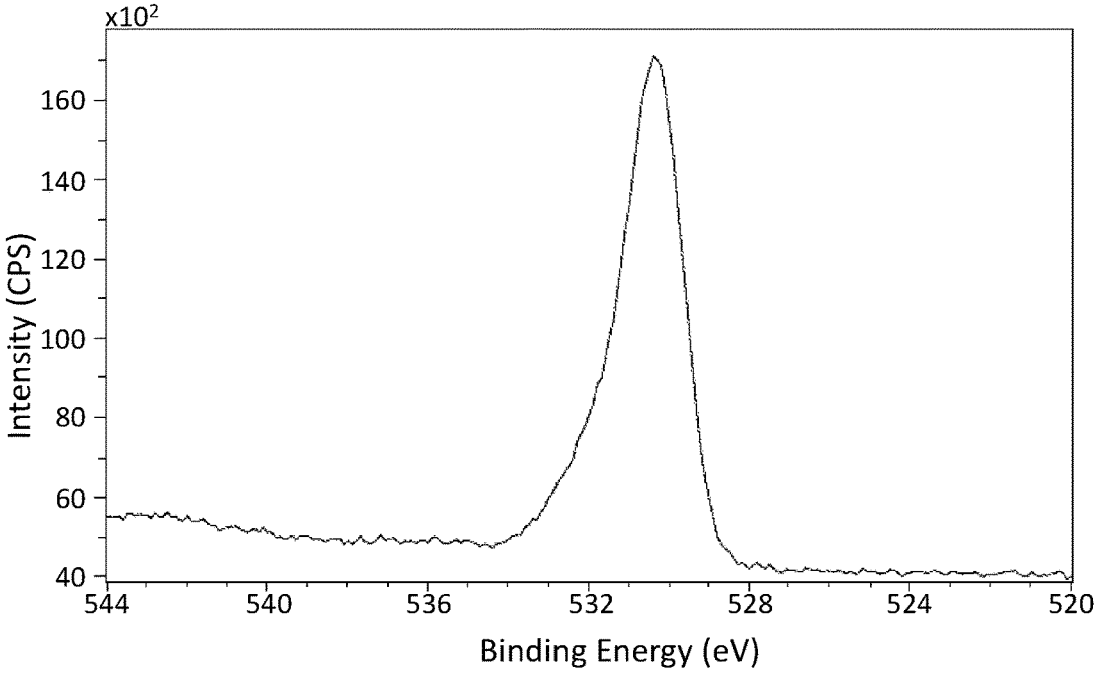
FIG. 36 is the O 1s region of the XPS spectrum of the substrate coated with the exemplary MoCC of FIG. 27, prior to sputtering.
Figure 37:
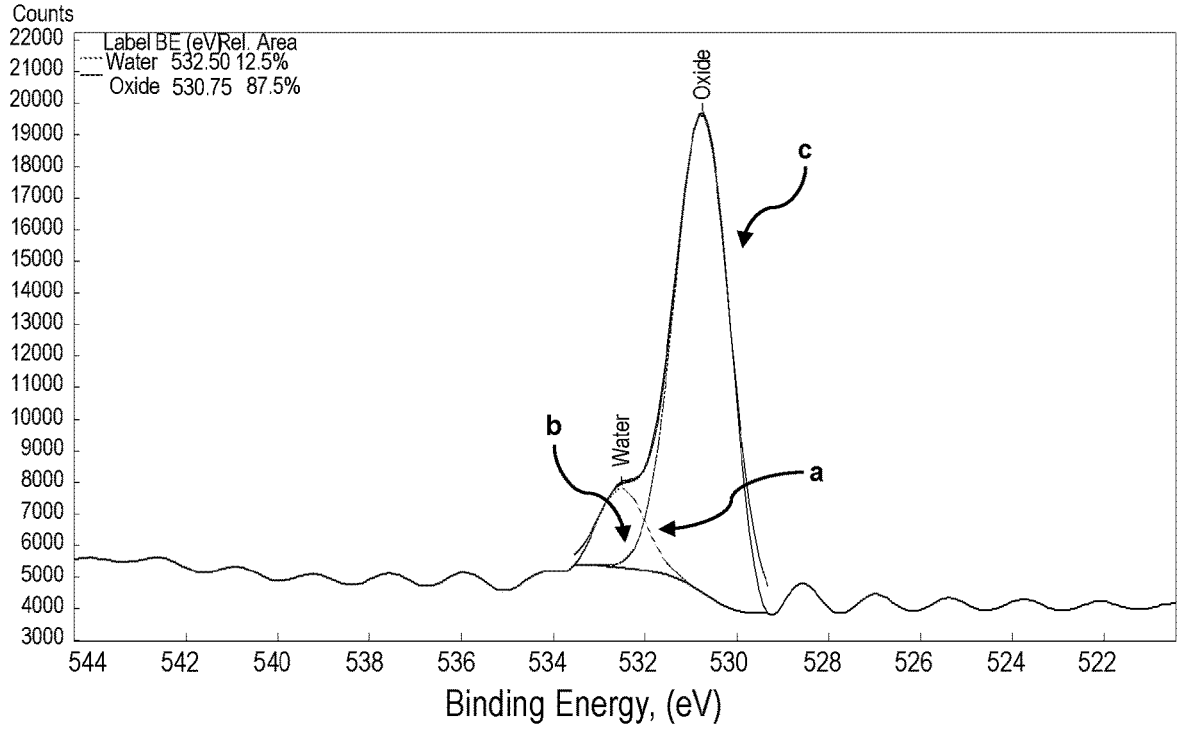
FIG. 37 is a fit of the data from FIG. 36, using smoothing and peak-fitting to differentiate the multiple peaks associated with the O 1s subshell; the line labeled "a" corresponds to oxygen present as water, the line labeled "b" corresponds to oxygen present as oxide, and the line labeled "c" is the smoothed fit of the peak of FIG. 36.
Figure 38:
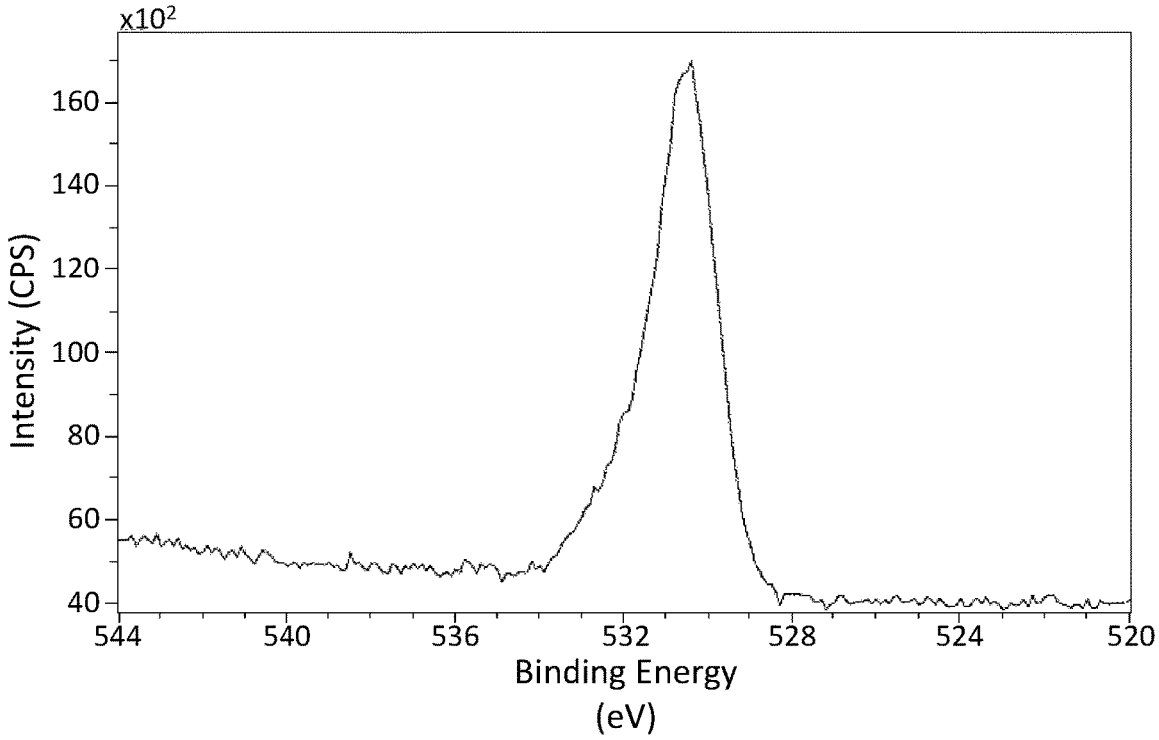
FIG. 38 is the O 1s region of the XPS spectrum of the substrate coated with the exemplary MoCC of FIG. 27, after sputtering.
Figure 39:
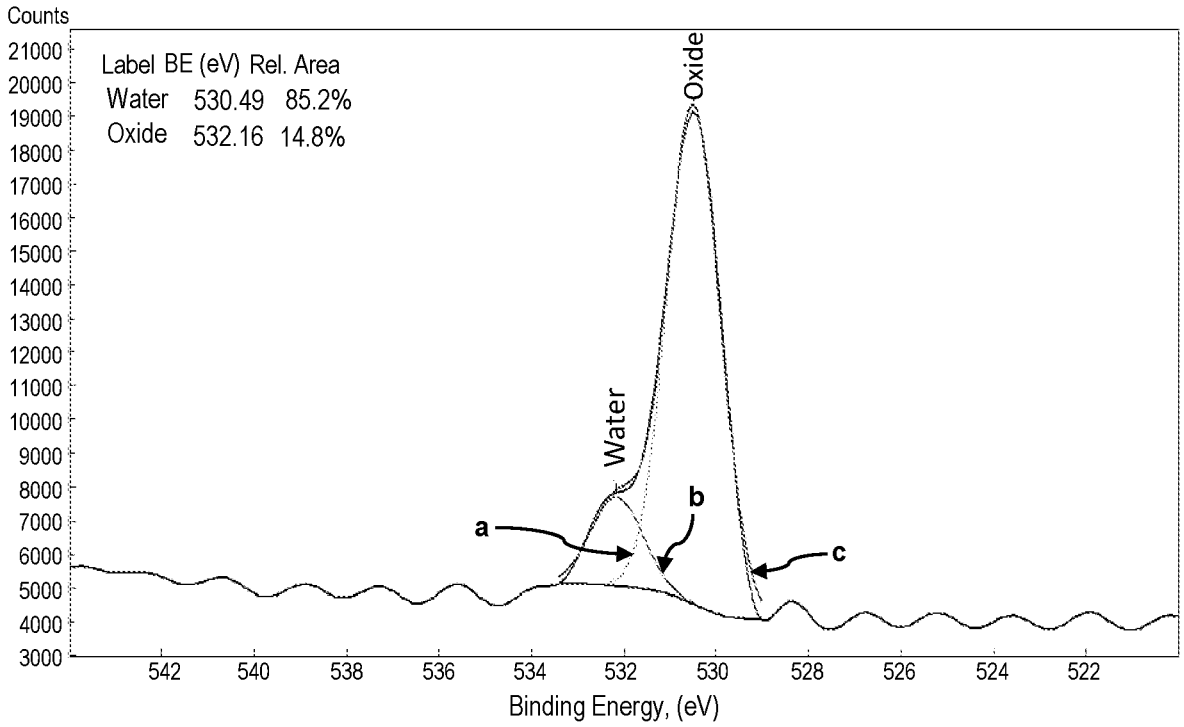
FIG. 39 is a fit of the data from FIG. 38, using smoothing and peak-fitting to differentiate the multiple peaks associated with the O 1s subshell; the line labeled as "a" corresponds to oxygen present as water, the line labeled as "b" corresponds to oxygen present as oxide, and the line labeled as "c" is the smoothed fit of the peak of FIG. 38.

The XPS spectra obtained in the oxygen is region are shown in FIG. 36 and FIG. 38 for MoCC coated AA2024-T6 samples, before and after sputtering, respectively. FIG. 37 and FIG. 39 display the peak-fitting results, and Tables 24 and 25 show the nature and composition of the species observed on the surface of the coated aluminum. In FIG. 37, the line labeled as "a" corresponds to oxygen present as water, the line labeled as "b" corresponds to oxygen present as oxide, and the line labeled as "c" is the smoothed fit of the peak of FIG. 36. In FIG. 39, the line labeled as "a" corresponds to oxygen present as water, the line labeled as "b" corresponds to oxygen present as oxide, and the line labeled as "c" is the smoothed fit of the peak of FIG. 38.

TABLE 24

Summary of Results for the Species of Oxygen before sputtering.

| BE(eV) | Species | Height | FWHM | Normalized Area | Relative Area % |
|---|---|---|---|---|---|
| 530.75 | Oxide | 15151 | 1.4 | 22578.2 | 87.5 |
| 532.5 | Water | 2527.2 | 1.2 | 3228.15 | 12.5 |

TABLE 25

Summary of Results for the Species of Oxygen after sputtering.

| BE(eV) | Species | Height | FWHM | Normalized Area | Relative Area % |
|---|---|---|---|---|---|
| 530.49 | oxide | 14816 | 1.4 | 70758 | 85.2 |
| 532.25 | water | 2653.4 | 1.2 | 12258 | 14.8 |

Due to the broadness of the peaks observed in FIGS. 36 and 38, multiple peaks were created for the fitted spectra in FIGS. 37 and 39. The analysis shows that the majority of oxygen on the surface of both samples is present in an oxide form, which is consistent with the species shown in Tables 22 and 23. The water that was found is likely a result of the hydration of the coating.

Table 26 shows the composition of MoCC before and after sputtering in terms of valency of Mo species in the coating. It can be seen that the outer layer is predominantly composed of oxidized forms ($Mo^{5+}$ and $Mo^{6+}$) while the inner layer is predominantly composed of reduced species ($Mo^{4+}$).

TABLE 26

Comparison of the MoCC coated samples by XPS before and after sputtering.

| Mo Species | % Composition Before Sputtering | After Sputtering |
|---|---|---|
| Mo (IV) | 0 | 41.1 |
| Mo (V) | 17.5 | 30.1 |
| Mo (VI) | 82.5 | 28.8 |

This data indicates that the MoCCs described herein are composed of multiple molybdate-based species including $MoO_2$, $Mo_2O_5$, $MoO_4$ and $MoO_3$. These MoCCs consist of two layers, with a surface layer primarily composed of oxidized Mo(VI), and an inner layer that is primarily composed of reduced Mo(IV) and Mo(V) species. This is illustrated in FIG. 40, which is a diagram illustrating the Mo species present in a cross-sectional view of an embodiment of a MoCC on an aluminum substrate. The thin layer on top contains species responsible for the repassivation behavior, while the underlying layer is the densest part of the coating and forms a protective barrier.

The molybdate-based compositions disclosed herein provide environmentally-friendly corrosion-protective molybdate coatings. Once the MoCCs are formed, tests determined that substrates coated with the MoCCs had improved corrosion resistance as compared to uncoated substrates, and it was shown that the MoCC was not just a superficial layer but was in fact protective of the underlying aluminum alloy substrate via anodic inhibition. Corrosion results are summarized in Table 27.

Comparative Example

In this example, a chromate conversion coating (CCC) was prepared and used for comparison with the MoCCs disclosed herein. The CCC-coated comparison sample was prepared as described by D Chidambaram, C. R. Clayton, G. P. Halada, and Martin W. Kendig, "Surface Pretreatments of Aluminum Alloy AA2024-T3 and Formation of Chromate Conversion Coatings I. Composition and Electrochemical Behavior of the Oxide Film", *Journal of The Electrochemical Society,* 151 (11), B605-B612, 2004, and the commercially-available Alodine® chromate conversion coating from Henkel Technologies.

Example 2

In this example, a MoCC was formed using Composition 2 (as described in Example 1), and its corrosion protection properties were compared with the CCC prepared in the Comparative Example. Specifically, the corrosion resistance of an aluminum substrate coated with MoCC Composition 2 were compared to an aluminum substrate coated with the CCC and an uncoated aluminum substrate, and the results are shown in Table 27.

TABLE 27

Summary of corrosion resistant parameters for a MoCC coated substrate, a CCC coated substrate, and an uncoated AA2024-T6 substrate.

| Sample | OCP (mV vs. Ag/AgCl) | Ecorr (mV vs. Ag/AgCl) | Icorr (μA) | βa (V/decade) | βc (V/decade) |
|---|---|---|---|---|---|
| MoCC formulation 2 on AA2024-T6 | −597.00 | −573.00 | 0.91 | 0.06 | 0.07 |
| CCC on AA2024- T3 | −550.00 | N/A | 0.10 | N/A | N/A |
| Uncoated AA2024-T6 | −670.00 | −739.00 | 4.21 | 0.28 | 0.26 |

As shown in Table 27, the MoCC exhibited similar OCP and $I_{corr}$ values as the CCC. The $I_{corr}$ value is indicative of corrosion rate.

The data shown in Examples 1-2 indicate that embodiments of the MoCCs disclosed herein possess the ability to self-heal. Using optical microscopy, it was observed that the blue color remained and the number of pits was reduced when compared to an uncoated sample. SEM revealed the surface morphology to consist of a mud cracked pattern that was similar to what would be seen on a sample coated with a CCC. XPS showed the MoCCs include multiple molybdenum-based species. Specifically, multiple valence states of Mo exist in the coating, such as $MoO_2$, $Mo_2O_5$, $MoO_4^{2-}$ and $MoO_3$. The surface of the MoCC is primarily composed of oxidized Mo(VI) and Mo(V), whereas the inner layer also included reduced Mo(IV).

This representative embodiment of the disclosed MoCC exhibits performance that is at the very least comparable to $Cr_2O_3$ and $CrO_4^{2-}$ oxides formed with CCCs in which the surface is composed of oxidized Cr(VI) and the inner layer is composed of reduced Cr(III). In this MoCC, the oxidized molybdates from outer layers migrate to active regions and repassivate any exposed alloy by getting reduced to Mo(IV). This data indicates that a molybdate-based coating can be a suitable replacement for CCCs for aluminum and its alloys.

Example 3

In this example, MoCCs were formed using permanganate $(MnO_4)^{-1}$ ions, and/or sulfate $(SO_4)^{-2}$ ions, sulfite $(SO_3)^{-2}$ ions, and/or thiosulfate $(S_2O_3)^{-2}$ ions. Exemplary composition embodiments of such MoCCs are summarized in Tables 28-30. These MoCCs exhibited corrosion resistance similar to that seen with CCCs, but that also is unexpectedly superior to that exhibited by other MoCC embodiments described herein.

TABLE 28

Additional Composition Embodiments

| Component | Concentration (mM) |
|---|---|
| Fluorine component (e.g., $K_2ZrF_6$, NaF, and/or $KBF_4$) | 0.1 to 75 |
| Iron component (e.g., $K_3Fe(CN)_6$) (optional) | $1 \times 10^{-3}$ to $5 \times 10^{-2}$ |
| Molybdate component (e.g., $Na_2MoO_4$) | 1 to 125 |
| Acid (optional) | $1 \times 10^{-2}$ to $10 \times 10^{-2}$ |
| Redox oxidizing component | 0 to 100 |
| Sulfur component (e.g., $Na_2S_2O_3$, $Na_2SO_4$, and/or $Na_2SO_3$) | 0 to 100 |

TABLE 29

| Composition Embodiment | |
|---|---|
| Compound/Ion | Concentration |
| Sodium Molybdate | 0.125 M |
| Potassium hexaflourozirconate | 0.05 M |
| NaF | 0.045 mM |
| $KBF_4$ | 0.16 mM |
| $Na_2S_20_3$ | 0.03 mM |
| $Na_2SO_4$ | 0.10 μM |

TABLE 30

| Composition Embodiment | |
|---|---|
| Compound/Ion | Concentration |
| Sodium Molybdate | 0.125 M |
| Hexaflourozirconate | 0.05 M |
| $KMnO_4$ | 5 mM |

Figure 41:
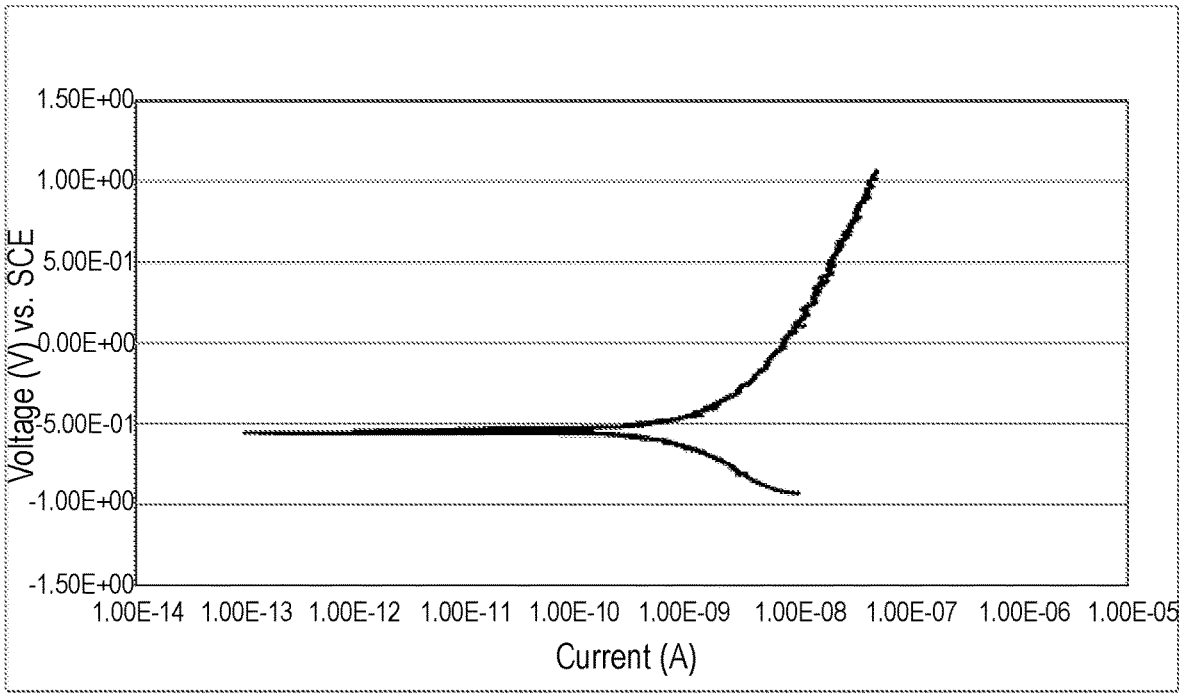
FIG. 41 is a graph of voltage as a function of time, providing the potentiodynamic polarization curve of an exemplary MoCC, as measured versus an Ag/AgCl reference electrode.
Figure 42:
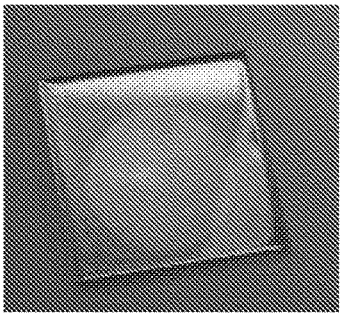
FIG. 42 is photograph of an aluminum substrate coated with a representative molybdate-based conversion coating (MoCC) as described herein, after polarization.

In one example, the composition of Table 29 was used to coat an aluminum alloy substrate by dipping the aluminum alloy substrate in a solution comprising the components of Table 29 for 5 to 10 minutes. The OCP of the coated substrate was −530 mV, as shown in FIG. 41, and FIG. 42 is a photograph of the coated substrate after polarization. In another example, the composition of Table 30 was used to coat an aluminum alloy substrate by dipping the aluminum alloy substrate in a solution comprising the components of Table 30 for 5 to 10 minutes. The OCP of the coated substrate was −700 mV.

Figure 43:
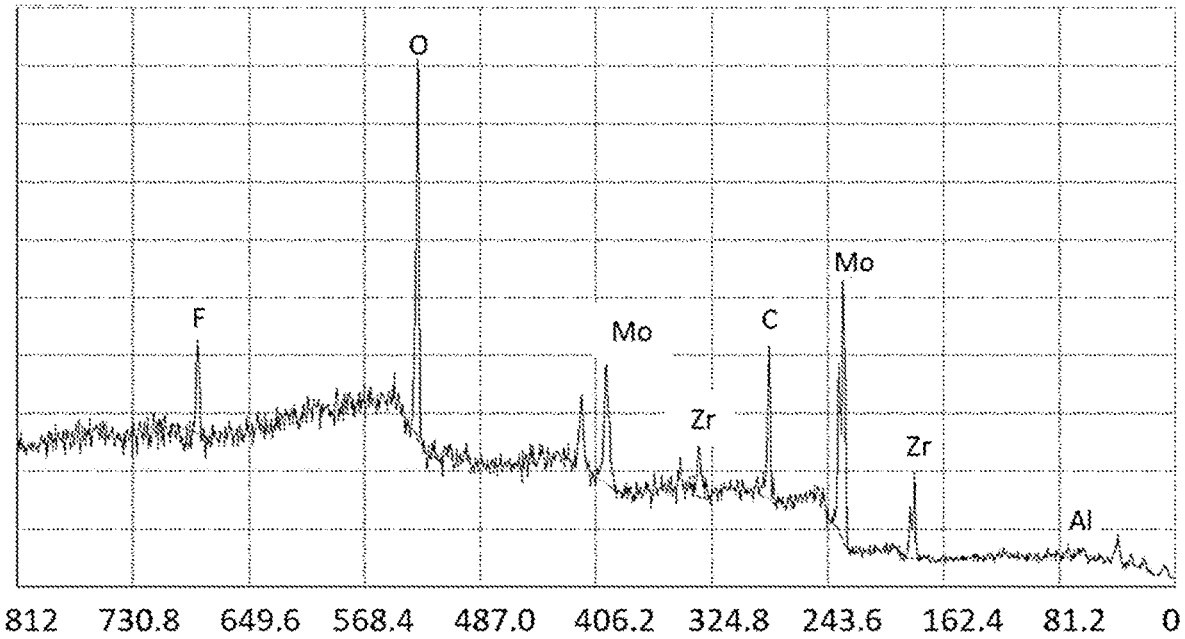
FIG. 43 is an X-ray photoelectron spectrum (XPS) obtained from analyzing a representative conversion coating formed from the composition described in Table 29 herein.

FIG. 43 is a spectrum obtained by analyzing the coating formed from the example detailed in Table 29. X-ray photoelectron spectroscopy was performed on the sample using a PHI 5600 spectrometer equipped with an Al-Kα source with a photon energy of 1486.6 eV. The source was operated at an accelerating voltage of 14 kV and an anode power of 300 W. The spectrometer dispersion and work function were calibrated to the Au $4f_{7/2}$ peak at 84.00 eV and the $Cu^2p_{3/2}$ peak at 932.67 eV to an accuracy of ±0.05 eV. Survey spectra were recorded with a step size of 0.5 eV and charge correction was performed to the adventitious C is peak at 284.8 eV. As can be seen by FIG. 43, Mo, Zr, F, Al, C, and O are present.

Comparing the $I_{corr}$ of the MoCC shown in FIG. 41 (i.e., 2.5 nA/cm$^2$) to the $I_{corr}$ of a conventional CCC (i.e., 100 nA/cm$^2$), the MoCC exhibits a corrosion protection that is superior to the corrosion protection of the CCC. In this particular example, the MoCC embodiment exhibited an $I_{corr}$ value that was 40 times lower than the conventional CCC embodiment.

Also, the $I_{corr}$, of the MoCC coating formed from a precursor solution comprising sulfate (e.g., the composition of Table 29) was lower than that observed for a MoCC coating formed from Composition 2, as was the $I_{corr}$, of MoCC formed from a precursor composition comprising permanganate. In particular, the $I_{corr}$, of the MoCC formed from the sulfate-containing composition was 2.5 nA/cm$^2$ and the $I_{corr}$ of the MoCC formed from the permanganate-containing composition was 200 nA/cm$^2$, whereas the $I_{corr}$, for the Composition 2 embodiment was 910 nA/cm$^2$. As such, MoCC coatings formed from compositions comprising a redox oxidizing component, such as a permanganate species, exhibited over 4 times better corrosion resistance than MoCC embodiments made from compositions solely comprising $K_2ZrF_6$, $K_3Fe(CN)_6$, and $Na_2MoO_4$. Also, MoCC embodiments formed from precursor compositions comprising a sulfur component provided 360 times better corrosion resistance than compositions solely comprising $K_2ZrF_6$, $K_3Fe(CN)_6$, and $Na_2MoO_4$.

In view of the many possible embodiments to which the principles of the present disclosure may be applied, it should be recognized that the illustrated embodiments are only preferred examples and should not be taken as limiting. Rather, the scope is defined by the following claims. We therefore claim as our invention all that comes within the scope and spirit of these claims.

We claim:

1. A composition, comprising:

10 mM to 75 mM of a single fluorine component having a formula $X_nY_mF_p$, or a combination of such fluorine components;

25 mM to 150 mM $X_2MoO_4$; and 1 mM to 15 mM of a redox oxidizing component comprising a permanganate species, a perchlorate species, a pertechnetate species, a perrhenate species, or a vanadate species;

wherein each X independently is a counterion selected from potassium, sodium, hydrogen, lithium, rubidium, or cesium;

Y is selected from B, Al, Ga, In, Zr, Ti, or Tl;

n is an integer selected from 1, 2, or 3;

m is an integer selected from 0, 1, 2, or 3;

p is an integer selected from 1, 2, 3, 4, 5, or 6; and wherein the pH of the composition ranges from 0.5 to 2.5, and the composition does not comprise chromium.

2. The composition of claim 1, further comprising (a) 0.0001 mM to 10 mM of an acid; (b) 0.0001 to 50 mM $Na_2SO_4$, 0.0001 to 50 mM $Na_2SO_3$, or a combination thereof; (c) 0.03 to 100 mM $Na_2S_2O_3$; or any combination of (a), (b), and/or (c).

3. The composition of claim 1, comprising:

50 mM to 75 mM NaF, or $K_2ZrF_6$, or $KBF_4$, or any combination thereof;

50 mM to 150 mM $Na_2MoO_4$; and 1 mM to 10 mM $KMnO_4$.

4. The composition of claim 1, comprising:

40 mM to 60 mM $K_2ZrF_6$;

100 mM to 130 mM $Na_2MoO_4$; and 2 mM to 10 mM $KMnO_4$.

5. The composition of claim 1, comprising:

0.125 M $Na_2MoO_4$;

0.05 M $K_2ZrF_6$; and 5 mM $KMnO_4$.

6. The composition of claim 1, wherein the composition further comprises $1\times10^{-3}$ mM to $5\times10^{-2}$ mM $X_3Fe(CN)_6$, wherein X is a counterion selected from potassium, sodium, hydrogen, lithium, rubidium, or cesium.

7. A coating made from the composition of claim 1, the coating comprising:

one or more of $MoO_2$, $Mo_2O_5$, $MoO_4^{2-}$ and $MoO_3$;

fluorine ions; and ions formed from the redox oxidizing component, or sulfur ions, or a combination of ions formed from the redox oxidizing component and sulfur ions.

8. The coating of claim 7, wherein the ions formed from the redox oxidizing component are permanganate ions, perchlorate ions, pertechnetate ions, perrhenate ions, vanadate ions, and any combination thereof.

9. A method for making an object comprising a conversion coating, comprising:

exposing an object to a composition according to claim 1 for a time period sufficient to form a conversion coating on one or more surfaces of the object; and removing the coated object from the composition to provide the object comprising the conversion coating, wherein the conversion coating comprises one or more layers comprising one or more of $MoO_2$, $Mo_2O_5$, $MoO_4^{2-}$ and $MoO_3$ and wherein the conversion coating does not comprise chromium.

10. A composition, comprising:

0.1 mM to 75 mM of a single fluorine component having a formula $X_nY_mF_p$, or a combination of such fluorine components;

1 mM to 150 mM $X_2MoO_4$; and 0.0001 mM to 50 mM $X_2SO_4$, $X_2SO_3$, $X_2S_2O_3$ or any combination thereof;

wherein each X independently is a counterion selected from potassium, sodium, hydrogen, or lithium;

Y is selected from B, Al, Ga, In, Zr, Ti, or Tl;

n is an integer selected from 1, 2, or 3;

m is an integer selected from 0, 1, 2, or 3;

p is an integer selected from 1, 2, 3, 4, 5, or 6; and wherein the pH of the composition ranges from 0.5 to less than 3, and the composition does not comprise chromium.

11. The composition of claim 10, comprising 0.0001 mM to 5 mM $Na_2SO_4$ and 0.03 mM to 5 mM $Na_2S_2O_3$.

12. The composition of claim 10, comprising:

0.1 mM to 75 mM of a mixture comprising NaF, $K_2ZrF_6$, and $KBF_4$;

100 mM to 130 mM $Na_2MoO_4$;

0.0001 mM to 5 mM of a mixture comprising $Na_2SO_4$ and $Na_2S_2O_3$.

13. The composition of claim 10, comprising:

0.125 M $Na_2MoO_4$;

0.0502 M of a mixture comprising $K_2ZrF_6$, NaF, and $KBF_4$; and 0.03001 mM of a mixture comprising $Na_2SO_4$ and $Na_2S_2O_3$.

14. The composition of claim 10, further comprising 1 mM to 15 mM of a redox oxidizing component that comprises a permanganate species, a perchlorate species, a pertechnetate species, a perrhenate species, or a vanadate species.

15. A coated object, comprising:

an object comprising a top surface; and a conversion coating formed on the top surface of the object that covers or substantially covers the top surface of the object, wherein the conversion coating comprises one or more of $MoO_2$, $Mo_2O_5$, $MoO_4^{2-}$, and $MoO_3$ and exhibits an $I_{corr}$ value ranging between 0.0020 $\mu A/cm^2$ and 0.01 $\mu A/cm^2$.

16. The coated object of claim 15, wherein the conversion coating comprises an outer layer comprising Mo(VI) and Mo(V) and an inner layer comprising Mo(IV) and does not comprise chromium.

17. The coated object of claim 15, wherein the conversion coating exhibits anodic inhibition and/or repassivation within 60 seconds after damage to the substrate.

18. The coated object of claim 15, wherein the object comprises aluminum, magnesium, iron, or an alloy of aluminum, magnesium, and/or iron, or any combination thereof.

19. The coated object of claim 15, wherein the conversion coating has an open circuit potential of −500 to −750 mV versus an Ag/AgCl standard reference electrode.

20. The coated object of claim 15, wherein the conversion coating is formed from a composition, comprising:

0.1 mM to 75 mM of a single fluorine component having a formula $X_nY_mF_p$, or a combination of such fluorine components:

1 mM to 150 mM $X_2MoO_4$; and 1 mM to 15 mM of a redox oxidizing component comprising a permanganate species, a perchlorate species, a pertechnetate species, a perrhenate species, or a vanadate species;

wherein each X independently is a counterion selected from potassium, sodium, hydrogen, lithium, rubidium, or cesium;

Y is selected from B, Al, Ga, In, Zr, Ti, or TI;

n is an integer selected from 1, 2, or 3;

m is an integer selected from 0, 1, 2, or 3;

p is an integer selected from 1, 2, 3, 4, 5, or 6; and wherein the pH of the composition ranges from 0.5 to 2.5, and the composition does not comprise chromium.

21. The coated object of claim 15, wherein the conversion coating is formed directly on the top surface of the object.

* * * * *